US010130530B2

(12) United States Patent
Golden, Jr.

(10) Patent No.: US 10,130,530 B2
(45) Date of Patent: Nov. 20, 2018

(54) MECHANISM AND APPARATUS FOR WHEELCHAIR RECONFIGURATION

(71) Applicant: Stephen C. Golden, Jr., Menasha, WI (US)

(72) Inventor: Stephen C. Golden, Jr., Menasha, WI (US)

( * ) Notice: Subject to any disclaimer, the term of this patent is extended or adjusted under 35 U.S.C. 154(b) by 358 days.

(21) Appl. No.: 14/975,999

(22) Filed: Dec. 21, 2015

(65) Prior Publication Data

US 2017/0172822 A1 Jun. 22, 2017

(51) Int. Cl.
*A61G 5/06* (2006.01)
*A61G 5/02* (2006.01)
*A61G 5/10* (2006.01)

(52) U.S. Cl.
CPC ..... *A61G 5/024* (2013.01); *A61G 5/02* (2013.01); *A61G 5/027* (2013.01); *A61G 5/06* (2013.01); *A61G 5/10* (2013.01); *A61G 5/104* (2013.01); *A61G 5/1089* (2016.11)

(58) Field of Classification Search
CPC ..... A61G 5/02; A61G 5/024; A61G 5/027; A61G 5/06; A61G 5/10; A61G 5/104; A61G 5/1054; A61G 5/1083; A61G 5/1089
See application file for complete search history.

(56) References Cited

U.S. PATENT DOCUMENTS 3,137,276 A 6/1964 Weisser
3,170,362 A 2/1965 Mewse
3,192,820 A 7/1965 Pitzer
3,318,289 A 5/1967 Marynissen
4,132,423 A 1/1979 Chant
4,316,616 A 2/1982 Boivin
4,384,744 A * 5/1983 Barley ..... B60N 2/236 16/327
4,511,157 A 4/1985 Wilt, Jr.
5,273,304 A 12/1993 Berkheimer
5,280,937 A 1/1994 Needham
5,522,644 A * 6/1996 Peek ..... A47C 7/503 297/423.26

(Continued)

FOREIGN PATENT DOCUMENTS

DE 4107410 C2 3/1990
DE 19848634 A1 * 3/2000 ..... A61G 5/023

(Continued)

OTHER PUBLICATIONS

Requirement for Restriction/Election for U.S. Appl. No. 14/314,030, dated Oct. 11, 2015.

(Continued)

*Primary Examiner* — Joseph M Rocca
*Assistant Examiner* — Daniel S Yeagley

(57) ABSTRACT

Embodiments according to the present invention include a load transitioning mechanism which enables attachment and release of at least one ground-contacting adaptive implement, such as a multi-terrain caster wheel assembly, a motorized wheel, or a ski; embodiments further enable reversible reconfiguration of the wheelchair by a user between a.) an original load-bearing configuration utilizing the conventional forward caster wheels of the wheelchair, and b.) a modified load-bearing configuration utilizing the ground-contacting adaptive implement.

18 Claims, 34 Drawing Sheets

(56) References Cited

U.S. PATENT DOCUMENTS

| | | | | |
|---|---|---|---|---|
| 6,283,886 | B1 * | 9/2001 | Schumann | B60N 2/4435 192/15 |
| 6,308,804 | B1 * | 10/2001 | Roberts | B60T 1/04 188/2 D |
| 6,311,999 | B1 | 11/2001 | Kueschall | |
| 7,114,778 | B2 * | 10/2006 | Schuler | B60N 2/1615 297/367 R |
| 7,201,079 | B2 * | 4/2007 | Stemmer | B60N 2/167 297/353 |
| 7,261,309 | B2 | 8/2007 | Watwood | |
| 7,520,518 | B2 | 4/2009 | Peterson | |
| 7,735,847 | B2 | 6/2010 | Dougherty | |
| 7,766,342 | B2 | 8/2010 | Fast | |
| 8,152,192 | B2 | 4/2012 | Dougherty | |
| 8,348,293 | B1 | 1/2013 | Lasher | |
| 8,414,008 | B2 | 4/2013 | Hay | |
| 8,430,456 | B2 * | 4/2013 | Nowak | B62B 9/102 297/423.26 |
| 8,573,622 | B2 | 11/2013 | Papi | |
| 8,585,071 | B2 | 11/2013 | Golden, Jr. | |
| 8,613,350 | B2 | 12/2013 | Nease, III | |
| 8,651,507 | B2 | 2/2014 | Kylstra | |
| 8,684,113 | B1 | 4/2014 | Laconis | |
| 8,888,190 | B2 * | 11/2014 | Peek | A61G 5/1056 297/423.19 |
| 9,398,988 | B1 * | 7/2016 | DeMirza | A61G 5/025 |
| 9,700,469 | B2 * | 7/2017 | Golden, Jr. | A61G 5/06 |
| 9,808,384 | B2 * | 11/2017 | Golden, Jr. | A61G 5/10 |
| 9,867,747 | B2 * | 1/2018 | Maurer | A61G 5/14 |
| 2006/0071531 | A1 * | 4/2006 | Groth | A61G 5/12 297/423.26 |
| 2007/0018443 | A1 * | 1/2007 | Wilmot | A61G 5/00 280/755 |
| 2007/0096427 | A1 | 5/2007 | Knaub | |
| 2010/0237586 | A1 * | 9/2010 | Dougherty | A61G 5/06 280/304.1 |
| 2011/0099857 | A1 | 5/2011 | Thomas | |
| 2012/0169026 | A1 * | 7/2012 | Golden, Jr. | A61G 5/02 280/250.1 |
| 2013/0009372 | A1 | 1/2013 | Willis | |
| 2015/0001833 | A1 | 1/2015 | Golden, Jr. | |
| 2016/0101005 | A1 | 4/2016 | Golden, Jr. | |
| 2016/0151215 | A1 | 6/2016 | Golden, Jr. | |

FOREIGN PATENT DOCUMENTS

| | | | |
|---|---|---|---|
| FR | 2841462 | A1 | 1/2004 |
| WO | WO/2010/139507 | A1 | 9/2010 |
| WO | WO/2011/153585 | A1 | 12/2011 |

OTHER PUBLICATIONS

Office Action for U.S. Appl. No. 14/314,030, dated Mar. 9, 2017.
Notice of Allowance for U.S. Appl. No. 14/952,810, dated Mar. 13, 2017.
Notice of Allowance for U.S. Appl. No. 14/314,030, dated Jul. 5, 2017.

* cited by examiner

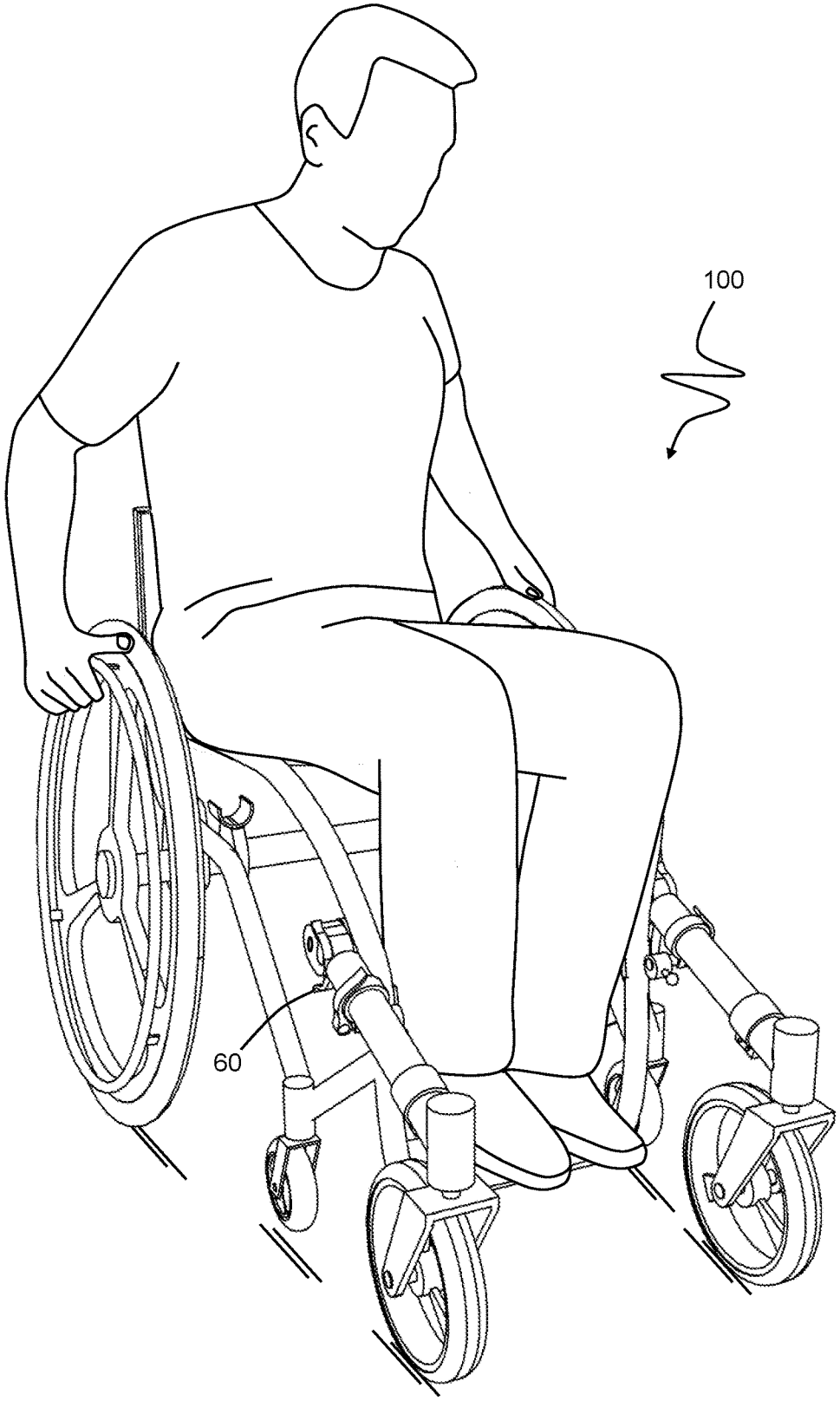
FIG. 1-I

MECHANISM AND APPARATUS FOR WHEELCHAIR RECONFIGURATION

BACKGROUND OF THE INVENTION

1. Field of the Invention

This invention relates to wheelchairs, related devices, and methods for use, particularly for personal mobility.

2. Description of Related Art

For many, the wheelchair serves as an essential conveyance for performing common activities that would otherwise be difficult, if not impossible, such as moving about in one's home, going shopping at the store, attending public gatherings, tending to a garden, and playing at the park with one's family. For some, such activities may be performed independently, while for others considerable assistance may be necessary; the wheelchair is thus useful in both the context of independent mobility and in that of assistive transportation of a person with a disability. Whereas the wheelchair has traditionally been viewed as an object of confinement, recent advances in wheelchair technology, improved accessibility standards, and increasingly open-minded attitudes regarding the topic of disability have elevated the wheelchair as a tool for health, personal enjoyment and freedom.

Individuals who utilize wheelchairs for their daily mobility typically do so under the direction of physicians, licensed physical therapists, and other clinicians who are well-versed in the application of adaptive mobility devices. Ideally, clinicians also educate and encourage their patients to engage in physical activity, to the greatest extent that their abilities will allow, for the sake of overall physical and psychological well-being. Such activity helps to maintain cardiovascular health, muscle strength and endurance, flexibility, range of motion, and an attitude of health and vitality. Additionally, clinical practices emphasize the independence and safety of the individual, looking at his or her day-to-day activities in the home, in the neighborhood, and in the surrounding community.

The contrast between indoor floor surfaces and outdoor terrain may vary depending on seasonal factors such as rain and snowfall, which significantly impact traction; this may be further influenced by the frequency of efforts in the locale, or lack thereof, to maintain and clear roadways, sidewalks, and driveways. For example, urban residences may benefit from prompt snow removal and de-icing services, whether by public services or by private grounds maintenance crews, whereas rural neighborhoods or farmsteads may not have access to such services. A wheelchair user residing rurally is thus likely to experience a more profound contrast between the indoor environment and that of the outdoors.

Transit in urban environments as well as long-distance travel involving transportation in vehicles such as cars, buses, trains, airplanes, small watercraft, or larger vessels, require the wheelchair user to adapt to the space allowed inside the vehicle upon boarding and to again adapt to the space outside the vehicle upon arriving at his or her destination. Quickly and successfully transitioning from one environment to the next requires knowledge and confidence on the part of the user as well as a suitably versatile wheelchair arrangement.

The aforementioned considerations are central to prior and ongoing efforts to develop adaptive devices which enable a wheelchair user, caretaker, assistant, or medical staff member to rapidly reconfigure a wheelchair according to the demands of the physical environment being encountered, especially in a manner which allows the user to remain comfortably seated throughout the process of reconfiguring the wheelchair.

SUMMARY OF THE INVENTION

In the context of technology in the art of wheelchairs and attachments therefor, the present invention concerns the challenge of wheelchair adaptability and addresses the need for rapid, robust, and versatile means for reconfiguring modern wheelchairs to meet the demands of a variety of environments to enable activities such as those illustrated above. Attempts have been made in the prior art to offer wheelchair users a solution to the need for fast and simple reconfiguration, particularly for all-terrain use, but there has remained a need for more robust, interchangeable, adjustable and customizable reconfiguration means.

Embodiments of the invention disclosed herein include a recline-action load-bearing transitioning mechanism for use with a wheelchair, the wheelchair having a frame, a pair of symmetrically-opposing rear drive wheels, and a pair of symmetrically-opposing forward primary caster wheels. The mechanism serves as a means for an occupant of a wheelchair, or an assistant thereof, to repeatably alternate the wheelchair between:

a) an original load-bearing configuration during which a load carried by the wheelchair is supported by the frame, the pair of rear drive wheels, and the pair of forward primary caster wheels, and b) a modified load-bearing configuration during which the load carried by the wheelchair is supported by the frame, the pair of rear drive wheels, and a load-transitioning mechanism integrated with a ground-contacting adaptive implement.

The mechanism thus alternates the wheelchair between the original load-bearing configuration and the modified load-bearing configuration to transform the load-bearing characteristics of the wheelchair while the wheelchair is supporting the seated occupant.

Embodiments of the present invention afford a wheelchair user improved ease and versatility by enabling the user to connect, willfully engage, willfully disengage, and disconnect the ground-contacting adaptive implement for use with the wheelchair, said adaptive implement operated by the user in conjunction with the transitioning mechanism to alternate the wheelchair between the original load-bearing configuration and the modified load-bearing configuration.

Upon willful alternation of the wheelchair to the modified load-bearing configuration, the ground-contacting adaptive implement is maintained in a deployed angular disposition during travel of the wheelchair in all directions, said adaptive implement moving in concert with movements of the wheelchair as it is motivated by the user towards a desired orientation or in a desired direction of forward or backward travel.

The ground-contacting adaptive implement may comprise a wheel, a pivotable caster, a wheeled suspension assembly, an omnidirectional wheel, a motorized wheel, a ski, a skid, or other such means for improving the user's ability to traverse difficult or unfamiliar terrain for which the unadapted wheelchair is poorly suited.

As a result of suitably reconfiguring the wheelchair to meet the demands of the terrain, the user benefits from improved forward stability of the wheelchair and decreased resistance during propulsion. Consequently, the user is relieved from excessive hand, arm, and shoulder strain and also the intense downward concentration otherwise required to avoid stones, cracks or other surface irregularities which obstruct free transit and which often pose a substantial safety issue due to the risk of tipping forward and falling out of the wheelchair. A subtle though readily noticeable result is that the user's head, neck and shoulders are maintained in a more comfortable posture, as the user is instead able to sit in a more comfortable upright position; he or she may now attend to more distant objects, enjoy taking in the surroundings, and fully relax the hands and arms after each propulsion cycle.

The mechanism is intended to be secured to at least one of the opposing forward frame tubes of the wheelchair, and the invention further comprises a user-accessible control switch to enable the user to prepare the transitioning mechanism for engaging and for disengaging the ground-contacting adaptive implement operatively connected to the transitioning mechanism without needing to exit the wheelchair or assume a difficult position while securing, operating, or releasing the device.

The mechanism defines a single joint and comprises a rotary overrunning clutch which selectably engages and disengages a rotatable portion of the joint connected to a ground-contacting implement relative to a fixed portion of the joint connected to the frame of the wheelchair. While disengaged, the rotatable portion rotates relative to the fixed portion about a substantially horizontal joint axis passing through said joint. While engaged, the rotatable portion is prevented from moving relative to the fixed portion and the rotary overrunning clutch bears torque in a first direction of rotation about the substantially horizontal axis as weight is supported through the entire mechanism and implement apparatus. Also, a rotation-limiting stop or detent prevents the rotatable portion from moving relative to the fixed portion in a second, opposing direction of rotation about the joint axis, which is suitably accomplished by integrating a detent bar, projection, or other such "stop" feature into at least one of the fixed portion and the rotatable portion. Such a feature may be disposed on or in close proximity to the load transitioning mechanism or, alternatively, may be disposed at a more distal location. Examples can be found in U.S. patent application Ser. No. 14/314,030, "Unilateral Transition Means for Adapting a Wheelchair," and U.S. patent application Ser. No. 14/952,810 "Reconfiguration Means for a Wheelchair."

Embodiments of the mechanism further comprise means for locking or binding the movable portion relative to the portion affixed to the wheelchair in order to substantially increase the rigidity of the connection therebetween; locking or binding capabilities are enabled by a releasable binding assembly comprising a screw, bolt, or a quick-release cam-lever, the latter similar to the type commonly used in bicycles such as for tubular seatpost adjustment or the like. Upon securing the releasable binding assembly in a binding disposition, relative movement or "play" is effectively eliminated between the rotatable portion of the device and the portion affixed to the wheelchair, with the exception of minor relative movement produced by deformative strain or flex induced in the structural members during normal use.

While deployed, the adaptive implement is releasably and solidly unified with the frame of the wheelchair, with the ground-contacting implement maintained in a predetermined angular orientation relative to the frame of the wheelchair, by virtue of said binding means and said rotation-limiting detent.

The mechanism may be incorporated into a convertible wheelchair having permanent or semi-permanent components attached thereto, said components intended for securing and transitioning at least one of an array of specialized ground-contacting adaptive implements through an operation sequence to alternate the wheelchair between an original load-bearing configuration and a modified load-bearing configuration, with the ground-contacting implement maintained in a predetermined angular orientation relative to the frame of the wheelchair while the wheelchair is in the modified load-bearing configuration.

Alternate characterizations of the present invention which include the recline-action load-bearing transitioning mechanism for the purpose of wheelchair reconfiguration are as follows:

i. a wheelchair-attachable ground-contacting reconfiguration apparatus;

ii. a wheelchair reconfiguration system for outfitting a wheelchair with at least one ground-contacting adaptive implement; and iii. a reconfigurable wheelchair capable of being outfitted with at least one ground-contacting adaptive implement.

In each of the aforementioned inventive settings, the included mechanism enables the user to willfully transition through a cyclic operation sequence as a means of reconfiguring the wheelchair while remaining comfortably seated in the wheelchair.

The present invention may also be characterized by a method in which the aforementioned mechanism is used to carry out the operation sequence necessary for attachment, engagement, disengagement, and detachment of at least one ground-contacting adaptive implement for the purpose of alternating the wheelchair between an original load-bearing configuration and a modified load-bearing configuration to transform the load-bearing characteristics of the wheelchair while the wheelchair is supporting a seated occupant.

The present invention may also be characterized by a method in which a wheelchair is equipped with the aforementioned mechanism to enable a user of the wheelchair, such as a seated occupant of the wheelchair or an assistant thereof, to carry out the operation sequence necessary for attachment, engagement, disengagement, and detachment of a ground-contacting implement to transform the load-bearing characteristics of the wheelchair while the wheelchair is supporting the seated occupant.

The present invention may also be characterized as a method for enabling transformation of a wheelchair between an original load-bearing configuration wherein a wheelchair-adapting implement may be freely attached to or removed from the wheelchair, and a modified load-bearing configuration wherein said wheelchair-adapting implement bears at least a portion of a load carried by the wheelchair, said method including: instructing the user to perform a cyclic operation sequence to enable the user to alternate the wheelchair between the original load-bearing configuration and the modified load-bearing configuration; and equipping the wheelchair for use with a single-jointed load transitioning mechanism adapted to enable the user to perform the cyclic operation sequence, the cyclic operation sequence comprising:

a) connecting a wheelchair-adapting implement in a position relative to the wheelchair to operatively interpose the single-jointed load transitioning mechanism between the wheelchair and the wheelchair-adapting implement;

b) transitioning the single-jointed load transitioning mechanism from an attach/release stage to a pre-deployment stage, comprising toggling an alternating switch to prepare a movable bearing for moving towards a position of engagement with a bearing surface;

c) transitioning the single-jointed load transitioning mechanism from the pre-deployment stage to a deployment stage, comprising the user reclining the wheelchair rearward between about 3 degrees and 6 degrees, wherein reclining the wheelchair enables the movable bearing to move into the position of engagement with the bearing surface;

d) transitioning the single-jointed load transitioning mechanism from the deployment stage to a pre-release stage, comprising toggling the alternating switch to prepare the movable bearing for moving away from the position of engagement with the bearing surface; and e) transitioning the single-jointed load transitioning mechanism from the pre-release stage to the attach/release stage, comprising the user reclining the wheelchair rearward between about 3 degrees and 6 degrees, wherein reclining the wheelchair enables the movable bearing to move out of the position of engagement with the bearing surface; and f) disconnecting the wheelchair-adapting implement from the position relative to the wheelchair.

The cyclic operation sequence consists of four distinct stages: an original load-bearing or "attach/release" stage, a transitional "pre-deployment" stage, a modified load-bearing or "deployment" stage, and a transitional "pre-release" stage. In order to carry out the full operation sequence, a controlled recline maneuver is performed to engender relative rotation between the portion of the apparatus affixed to the wheelchair and the rotatable portion connected to the ground-contacting adaptive implement. Said controlled recline maneuver serves as an essential means by which the user effectuates alternating movements of the movable bearing(s) contained within the mechanism.

The controlled recline maneuver, also referred to as a "wheel-stand maneuver" or a "wheelie," involves a momentary, controlled recline motion that is a useful and well-known aspect to everyday wheelchair maneuvering and which is taught to many wheelchair users by physical rehabilitation clinicians. The wheel-stand maneuver simultaneously moves the overall user-wheelchair center of gravity rearward, reclines the seat, backrest, and frame, and elevates the front of the wheelchair. To a similar end, preferred embodiments may usefully enable an assistant to controllably recline the occupied wheelchair, such as from behind the seat of the wheelchair, while grasping handles or other rigid features affixed to or integrated with the backrest of the wheelchair.

An apparatus according to the present invention also utilizes the force of gravity for engendering said relative movement of the affixed portion and the rotatable portion about the rotation axis passing through the load-transitioning mechanism. During the wheel-stand maneuver, the apparatus is subject to angular changes of the wheelchair frame as well as the downward force of gravity acting upon the apparatus as the front of the wheelchair is elevated from contact with the ground surface. Assuming the wheelchair is situated on a level ground surface, the downward force of gravity is orthogonal with respect to an overall recline axis about which the whole wheelchair and the user's body rotate during the wheel-stand maneuver. Accordingly, preferred embodiments of the present invention are configured with the joint axis of the mechanism at the union of the affixed portion and the rotatable portion wherein relative rotation is enabled between the affixed portion and the rotatable portion, about the substantially horizontal axis, as the user controllably reclines the wheelchair.

The horizontal axis, though preferably parallel to the overall recline axis of the whole wheelchair during the wheel-stand maneuver, may instead be oriented longitudinally or diagonally with respect to the frame of the wheelchair without departing from the spirit of the invention. Furthermore, the frames of many modern wheelchairs have front angles which substantially deviate from vertical, such as those having an inward taper and a forward projection of the front tubes leading down towards the footrest; such frame geometries may impose a deviation of the joint axis of the mechanism away from being perfectly horizontal. Additionally, many wheelchairs have seat angles which substantially deviate from horizontal, such as those having a difference between front and rear height of the longitudinal seat support tubes. Thus, depending on the geometry of the frame portion to which the apparatus is attached, which may include tubing, plates, or other structural components, useful adjustment means including bolts, screws, plates, collars, clamps, or the like, may be necessary to fix the axis of the primary joint of the transitioning mechanism in a substantially horizontal orientation to properly utilize the force of gravity while performing the wheel-stand maneuver to ensure correct functioning of the transitioning mechanism.

While in the modified load-bearing configuration, the forward primary caster wheels of the wheelchair are, preferably, elevated so that they are free from contact with the ground surface, such that a clearance gap measuring at least about 5 mm is maintained below the bottom of the forward primary caster wheels as the wheelchair is rolled over a flat surface. The clearance gap may, instead, measure about 10 mm, 15 mm, 20 mm, 25 mm, 30 mm, 35 mm, 40 mm, 45 mm, or 50 mm, depending on the user's preferences. A larger clearance gap will help to ensure that the forward primary caster wheels do not contact loose or rough terrain below, but will recline the wheelchair seat rearward and will markedly alter the user's posture. On the other hand, a smaller clearance gap will increase the likelihood that the forward primary caster wheels will contact loose or rough terrain below, at times imposing increased rolling resistance, but will also maintain the user in a less reclined, more upright seated posture.

In order to reliably support downward loading due to the weight of the wheelchair and the occupant, the movable bearing of the mechanism must transmit torque through the joint of the mechanism in a manner which does not allow slipping to occur between the opposing first and second bearing surfaces, and this may be achieved through one of a variety of different types of movable bearing arrangements. Examples may be found in the prior art which exemplify useful arrangements comprising a movable bearing which is selectably engaged and disengaged for the purpose of releasably transmitting torque about a singular joint.

Some examples utilize a linearly protracting-retracting bearing arrangement. That which is described in U.S. patent application Ser. No. 14/314,030, "Unilateral Transition Means for Adapting a Wheelchair," includes the provision of a protracting and retracting load-transmission assembly to alternate a movable bearing into and out of a torque-bearing position. In U.S. Pat. No. 6,308,804, "Quick Connect Wheelchair Brake Lock," a rotary lock system is described in which a cone-shaped actuator pin contained within a load-bearing pin housing is alternated by a cam-actuated slide mechanism between a protracted position and a retracted position relative to a chamfered receiving hole, for the purpose of inhibiting rotation of a wheel. In both cases, torque is transmitted through—or alternatively stated, rotation is inhibited relative to—the movable bearing from a first bearing surface to an opposing, second bearing surface.

Other examples, such as those found in the art of roller-based and sprag-based overrunning clutches, employ arcuate movement of a movable bearing about the axis of a primary joint to engender releasable torque transmission. Arcuate or circumferential movement of at least one movable bearing by a cage, or similar means of applying urging force thereagainst, urges the movable bearing into and out of a wedged disposition between opposing first and second bearing surfaces of the primary joint, for the purpose of transmitting torque—or for inhibiting relative rotation—in a desired direction between a first bearing surface and an opposing, second bearing surface. Examples can be found in U.S. Pat. No. 2,427,120 "Two-way Overrunning Clutch," U.S. Pat. No. 3,476,226 "Overrunning Clutch With Controlled Operation," and U.S. Pat. No. 7,261,309"Wheelchair Drive Mechanism." Furthermore, that which is described in U.S. patent application Ser. No. 14/952,810, "Reconfiguration Means For A Wheelchair,"includes the provision of a rotary switch mechanism to alternate a plurality of movable bearings, contained within a releasable overrunning clutch into and out of a torque-bearing relationship between a first bearing surface and a second bearing surface.

In an embodiment of the present invention, a ratcheting-pawl overrunning clutch mechanism comprises a pivotable pawl which functions as a movable bearing; the mechanism further comprises an engagement surface and has a primary pivot joint having a rotatable portion connected to a ground-contacting implement and a fixed portion connected to the frame of the wheelchair. Articulated rotation of the pawl about its own pawl pivot joint permits selectable load-bearing captivation of the pawl between a first bearing surface and a second bearing surface to releasably transmit torque between the opposing first and second bearing surfaces. Said joints exhibit a slight amount of rotational play to allow for free rotation of the pawl upon alternation to the original load-bearing configuration by way of the user manipulating the switch of the transitioning mechanism and subsequently performing the wheel-stand maneuver. The pawl and the second bearing surface may both further comprise a plurality of teeth to promote engagement therebetween and to ensure that slipping does not occur during the modified load-bearing mode.

In preferred embodiments, the first bearing surface and the second bearing surface are configured with sufficient clearance therebetween to allow for translation or rotation of the movable bearing, or a combination of these movements, upon urging of the movable bearing in the selected direction and performing the wheel-stand maneuver. In addition, the first and second bearing surfaces are materially composed to withstand compressive contact with the movable bearing while also permitting release from contact upon arming the mechanism to sustainedly urge the movable bearing away from contact and upon subsequently performing the wheel-stand maneuver to effectuate said release from contact.

The mechanism further includes a reversible force sustainment subassembly to enable the user to selectably place the mechanism in either a state of sustainedly urging the movable bearing towards contact with the bearing surfaces or a state of sustainedly urging the movable bearing away from said contact. In preferred embodiments of the present invention, the reversible force sustainment subassembly comprises a manipulable switch operatively connected to at least one force sustaining spring, wherein the force sustaining spring is capable of sustainedly supplying an urging force to the movable bearing and wherein the force sustaining spring is further capable of removing said urging force. A suitable force sustaining spring may be a compression spring, an extension spring, or a torsion spring, operatively interposed between a user-controlled actuator, such as a knob or handle, and a cage of the overrunning clutch adapted for displacing a movable bearing or a plurality thereof.

In preferred embodiments, force sustainment means combine with a releasable overrunning clutch to form a mechanically-actuated load transitioning mechanism, wherein said manipulable switch comprises a knob or handle, a lever arm, and said force sustaining spring is composed of steel, stainless steel, nickel, titanium, or an alloy thereof, or a suitable elastomer, wherein the spring is capable of assuming a relaxed form and a deflected, extended, compressed or otherwise tensed form.

A variety of switch and spring arrangements may be usefully implemented to serve as force sustainment means and remain within the spirit and scope of the present invention. Embodiments of the mechanism, which require a first sustaining force application means and a second, opposing sustaining force application means, may comprise any combination of extension, compression, or torsion springs or, alternatively, may comprise any other type of solid elastomeric element, in order to enable biasing of an overall "net" urging or sustaining force applied against the movable bearing. In some embodiments, the included reversible force sustainment subassembly comprises a single force sustainer, such as a spring, capable of deflecting in both a forward and a reverse direction to provide sustained force application against the movable bearing for selectable engagement and disengagement.

Force sustainment means may include a force sustainer cam and lever arrangement wherein upon rotating the lever about an axis passing through the force sustainer cam, the force sustainer cam imparts an alternation of the urging force against the movable bearing, thus enabling the user to repeatably toggle the mechanism between an engaging state and a disengaging state by manipulably imparting rotation to the force sustainer cam, via the lever, between two alternate positions. Furthermore, the force sustainer cam may composed of an elastic or otherwise deformable material which becomes compressed while the force sustainer cam is oriented to apply sustaining force against the movable bearing; such compressibility serves to enhance the sustained force against the movable bearing while also permitting a degree of movement of the movable bearing that may, for example, be required to permit a plurality of engagement teeth of a pawl-type movable bearing to advance over a plurality of engagement teeth of a toothed torque wheel.

Force sustainment means may include a linearly protracting-retracting assembly, as disclosed in U.S. patent application Ser. No. 14/314,030, wherein upon initially depressing or sliding a manipulable button or knob in a forward direction, the movable bearing is locked in a protracted position and wherein a second depression or sliding of the button or knob in the forward direction will retract the movable bearing into a retracted position, and wherein the sequence of protraction and retraction can be repeated.

Especially in the case of a roller-based or sprag-based overrunning clutch mechanism, suitable force sustainment means may include a rotatably-actuated arrangement such as a switchable rotary clutch capable of being alternated between a state of forward torque-bearing and a state of zero or reverse torque-bearing, wherein a switch lever is configured to be positioned along an arcuate path and to revolve about a rotary axis passing centrally through the load-transitioning mechanism. Upon the user manipulating said switch lever so that it comes to rest in a first retention groove along the arcuate path (or otherwise maintained in a first position), an internal spring biasing force placed upon the overrunning clutch is alternated to enable forward torque-bearing; upon the user manipulating said switch lever so that it comes to rest in a second, opposing retention groove along the arcuate path (or otherwise maintained in a second position), an internal spring biasing force placed upon the overrunning clutch is alternated to disable forward torque-bearing.

In embodiments comprising biasing or force sustainment means as described above, reversible force application means may include a first force sustainer such as a spring or elastomer capable of sustained force application against the movable bearing in an engaging direction and may further include a second such force sustainer capable of sustained force application against the movable bearing in an opposite, disengaging direction. At times when the force applied in the engaging direction is greater than the force applied in the disengaging direction, the net force applied against the movable bearing will favor engagement of the movable bearing with both bearing surfaces. Conversely, when the force applied in the engaging direction is less than the force applied in the disengaging direction, the net force applied against the movable bearing will favor disengagement of the movable bearing from at least one of the bearing surfaces.

Whether reversible force application means comprise a single reversible force sustainer or dual opposing force sustainers, the mechanism is configured to ensure that while the adaptive implement is non-load-bearing, upon the user placing the manipulable switch in a first position the movable bearing will be urged with sufficient force to establish and maintain contact with both the first and second bearing members. Now, in this non-load-bearing pre-deployment stage, upon the user engendering relative forward rotation of the first and second bearing surfaces by performing the wheel-stand maneuver, the movable bearing will be securely captivated between the first and second bearing surfaces, thereby transitioning the mechanism to the load-bearing deployment stage.

The mechanism is also configured to ensure that, while the forward portion of the load of the wheelchair is being supported by the adaptive implement during the deployment stage, upon the user placing the manipulable switch in a second position sufficient force will be applied against the movable bearing in a disengaging direction. Now, in this load-bearing pre-removable stage, upon the user engendering slight relative reverse rotation of the first and second bearing surfaces by performing the wheel-stand maneuver, the movable bearing will release from frictional binding or captivation between the first and second bearing surfaces, allowing it to instantly move away from its position of load-bearing engagement, thereby transitioning the device to the non-load-bearing releasable stage in which the user is enabled to remove the adaptive implement from the wheelchair.

Force sustainment means may comprise a user-manipulable switch housed separately from, though operatively connected to or in communication with, the movable bearing. Remote actuation, for the purpose of controlling the urging forces applied against the movable bearing, may instead be accomplished by transmitting linear force through an ensheathed cable or by a flexible rotary shaft, for example.

Force sustainment means, such as those described above, effectively translate a momentary manipulation of the switch by the user into a sustained application of force against the movable bearing to enable performance of the wheel-stand maneuver at a later, separate instant, to facilitate transitioning the mechanism through the cyclic operation sequence. In preferred embodiments, the duration of a switch manipulation event is substantially less than the duration of force application against the movable bearing, such as at least about one or two seconds less or at least about several seconds less. The duration of force application against the movable bearing may, in preferred embodiments, lasts as long as the user waits before performing the wheel-stand maneuver, wherein the resulting delay affords the user, upon toggling the switch, a sufficient amount of time to ready him- or herself in an upright seated position to comfortably and safely perform the wheel-stand maneuver.

It will be appreciated by those skilled in the art that the transition from the attach/release stage to the deployment stage involves the same intuitive, intentional actions that are required to carry out the transition from the deployment stage back to the attach/release stage. Advantageously, the user is afforded the ability to ready the device for transitioning, and then attend to performing the wheel-stand maneuver at a later instant, thereby making the operation simple for the user to carry out. Furthermore, the user is prevented from accidentally transitioning the device from the deployment stage to the attach/release stage as it is unlikely that he or she will unknowingly toggle the manipulable switch and unintentionally perform the wheel-stand maneuver. As a result, the user enjoys a safe and predictable experience both while the wheelchair is in its modified load-bearing configuration and during all moments of transitioning through the cyclic operation sequence.

Embodiments of the invention include forward rotation limiting means, such as a forward limit stop, to define a rotational endpoint in a forward direction of rotation, beyond which the ground-contacting adaptive implement is prevented from further rotation about the axis of the joint as the user performs the wheel-stand maneuver. In some embodiments, said rotation limiting means are disposed locally—that is, within or directly connected to the housing of the mechanism. The forward limit stop may be externally connected to a portion of the joint or, alternatively, contained inside the protective housing, wherein a rotary projection contacts the forward limit stop during relative rotation of the first joint member and the second joint member. In other embodiments, a rotation-limiting projection is disposed remotely, such as a bar or stand-off attached to the support arm which connects the adaptive implement to the housing of the mechanism, said rotary projection configured to contact a portion of the frame of the wheelchair as the user performs the wheel-stand maneuver, similarly defining the rotational endpoint in the forward direction of rotation. Whether disposed locally or remotely relative to the housing of the mechanism, it may be useful to include a compressible elastomeric element on at least one of the two opposing contact surfaces to enable a very slight degree relative rotation to transition the mechanism from the pre-release stage to the attach/release stage, upon compression of said elastomeric element between the movable joint member and the fixed joint member when performing the wheel-stand maneuver.

In some embodiments, it may be advantageous to incorporate a cam and lever assembly with the rotation limiting bar, stand-off or rotation-limiting projection to enable the user to impose relative tension among the movable bearing and the first and second bearing surfaces during the deployment stage to help increase the overall rigidity of the joint; such an arrangement thus serves as a releasable means for indirectly imposing pressure against the movable bearing to inhibit relative movement between the first bearing surface and the second bearing surface. As in the preceding paragraph, it may be of use to include a compressible elastomer in the contact portion of the cam.

Alternatively, it may be preferred in some embodiments to incorporate a clamp or a cam-actuated bar adapted to enable the user to tightly draw or affix the rotary portion of the apparatus against the frame of the wheelchair or against a portion of the apparatus fixed thereto, for the purpose of inhibiting movement of the rotary portion and thus increasing the rigidity of the connection of the adaptive implement to the wheelchair.

In embodiments of the invention, it may be preferable to incorporate, projecting through the protective housing, a cam and lever assembly comprising a tensioning skewer, said cam and lever assembly configured to releasably apply pressure or tension directly against the movable bearing, especially after the user has transitioned the mechanism to the deployment stage of operation, at which time it is most desirable to rigidize the joint.

Embodiments may thus include releasable means for both indirect and direct binding of the movable bearing in a fixed position to inhibit relative movement between the first bearing surface and the second bearing surface. Whether utilized separately or in combination, such means for inhibiting relative movement between opposing bearing surfaces (and thus, opposing joint members) serves to add rigidity to the union between the wheelchair and the attached ground-contacting adaptive implement, which is especially useful in situations where flutter of the adaptive implement is more likely to occur due to vibration. In addition, direct or indirect inhibition of bearing movement helps to further prevent accidental transition of the load-transitioning mechanism during use. Therefore, such provisions for rigidizing the joint during the deployment stage of operation confer enhanced stability and reliability, in turn improving the performance and safety of the vehicle during use.

By including provisions for indirect or direct binding for the purpose increasing the rigidity of the connection of the adaptive implement to the wheelchair, additional stages are involved in cycling through the operation sequence to include binding and unbinding of the mechanism. Thus, the full operation sequence is as follows: 1.) unbound, attach/release stage; 2.) unbound, pre-deployment stage; 3.) unbound, deployment stage; 4.) bound, deployment stage; 5.) bound, pre-release stage; 6.) unbound, pre-release stage; 7.) return to the unbound, attach/release stage (to enable release of the adaptive implement).

The mechanism is enclosed within a protective housing to keep out dirt, debris, and moisture to prevent unwanted wear and corrosion of the bearing components, force sustainers, and related structures.

The option of adapting the same wheelchair in a variety of configurations would be appreciated by a person experienced in the art of adaptive wheelchair mobility as being advantageous as a consequence of the versatility afforded to the user. Active wheelchair users, for example may wish to utilize such a means for recreation, exercise, or for enjoyment of scenic or otherwise enjoyable locations outdoors which might include nature trails, playgrounds, grassy fields, snow-covered areas, and muddy or swampy areas. Other activities may be performed out of necessity, such as negotiating a rough gravel driveway or other path to access a garage, mailbox or wood shed. Occupational, avocational, and "everyday" activities which may be addressed at least in part by embodiments of the present invention include outdoor chores such as maintaining trees, shrubs, gardens, and other landscaping work, which at the very least require the individual to be able to negotiate terrain that is unlikely as flat and smooth as indoor floor surfaces.

Asymmetric configurations may be desirable in cases where a single laterally-attached implement is sufficient for performing the task at hand. As an example, it may be suitable to use a single large all-terrain caster implement to place the wheelchair in a three-wheel configuration wherein the primary casters of the wheelchair are elevated and unloaded and the all-terrain caster implement is positioned in front of the wheelchair and in alignment with a vertical longitudinal centerline passing through the wheelchair. Examples are illustrated in U.S. patent application Ser. No. 13/249,278 "Asymmetric Open-Access Wheel Chair" and in U.S. Pat. No. 8,585,071 "Releasable Forward Wheel Apparatus For A Wheelchair."In such examples, a single caster imparts additional forward stability and reduced rolling resistance to the wheelchair while also permitting the user to transfer to and from the seat of the wheelchair with minimal obstruction to the user's legs and feet at a forward lateral region of the wheelchair.

Whether utilizing symmetric or asymmetric attachment configurations, it is necessary to ensure releasable, secure alignment and retention of attached adaptive implements connected to the frame of the wheelchair. For the sake of versatility and convenience, embodiments include provisions for switching out or swapping different ground-contacting adaptive implements for the purpose of quickly reconfiguring the wheelchair, preferably to enable interchangeable attachment of an array of adaptive implements to the wheelchair. Provisions to ensure releasable, secure alignment and retention may include:

a) insertable alignment pins, such as those having a ball and a spring configured to resist pullout, or a positively locking ball detent mechanism to ensure pullout does not occur unless a button is depressed;
b) an expanding insertion pin, wherein compressive force holds the pin in tight engagement within a receptacle to establish a unified, "play-free" and "wiggle-free" connection between the separable adapting member and the mounting member;
c) a coupling comprising a solid or tubular insert having a round profile, used in conjunction with an anti-rotation collar for preventing rotation of coupled members;
d) couplings comprising solid or tubular inserts having polygonal, spline, or keyed profiles for preventing rotation of coupled members;
e) quick-release collars for releasably securing coupled members.

In preferred embodiments, the adaptive implement is secured relative to a forward portion of the wheelchair in a releasable fashion, including simple, fast and easy means of attaching and releasing the entire apparatus to and from the forward portion of the wheelchair. In variations thereof, a system according to the present disclosure may be configured for leaving a mounting member attached to the wheelchair, whether clamped, bolted, welded or otherwise permanently or removably secured to the wheelchair, to facilitate attaching and releasing of the apparatus by way of a separable adapting member comprising quick-release features.

In preferred embodiments of the invention, the joint of the mechanism and all attachment components are sufficiently rigid so that the performance, safety, and longevity of all fixed and movable components of the transitioning mechanism, as well as those secured to the wheelchair, are substantially unaffected by torsional strain and asymmetric loading placed upon the apparatus as a result of a load borne completely or in part by the apparatus.

Sufficient movement of the movable bearing is necessary to enable rapid and reliable attachment, operation, and detachment to successfully transition the device through the cyclic operation sequence. In particular, the joint of the mechanism must exhibit a minimum degree of rotation during the pre-release stage to enable transition to the attach/release stage, such as at least about 0.5 degrees, or at least about 1.0 degrees, or at least about 2.0 degrees, or at least about 5.0 degrees of relative rotation between the first and second bearing surfaces. A sufficiently robust joint helps to isolate this requisite rotation without introducing unwanted play or wiggle of the joint and ensures strong, secure and play-free load-bearing engagement of the movable bearing between the first and second bearing surfaces during the modified load-bearing mode.

Advantages set forth by embodiments of the present invention may be achieved by exploiting at least one lateral portion of the wheelchair which, especially in the case of rigid-type "everyday" wheelchairs, is predominantly devoid of structural components and accessories. Patents such as U.S. Pat. No. 7,520,518, "Wheelchair" issued to Peterson, et al. and U.S. Pat. No. 6,311,999 "Wheelchair With A Closed Three-dimensional Frame" issued to Kueschall, and U.S. Pat. No. 8,573,622 "Wheelchair" issued to Papi, which exemplify modern wheelchairs and architectures thereof, may be useful for visualizing the relevant lateral regions of such wheelchairs and for appropriately applying transition means for purposes described herein. In many cases, the aforementioned lateral region is suitable, spatially and structurally, for accommodating elements necessary for reliable attachment of adaptive devices to robust portions of the wheelchair and for convenient operation of the load-transitioning mechanism, including manipulation of the switch by the user.

In a first embodiment configuration of the present invention a single load-transitioning mechanism connects an adaptive implement, in an asymmetric fashion, to a lateral portion on a first side of the wheelchair. In a second embodiment configuration, a first load-transitioning mechanism connects a first adaptive implement to a lateral portion on a first side of the wheelchair and a second load-transitioning mechanism connects a second adaptive implement to a lateral portion on a second, opposing side of the wheelchair. In a third embodiment configuration, a single load-transitioning mechanism connects one or more adaptive implements to opposing lateral portions on both sides of the wheelchair in a symmetric, bilateral fashion. In each of the aforementioned cases, significant torsion is likely to be experienced due to imbalanced loading which occurs either due to lateral placement of the apparatus or simply by virtue of asymmetric contact of the adaptive implement with the ground surface. Therefore, proper functioning of all embodiments the present invention must withstand imbalanced or asymmetric forces placed upon clamping members, support members, and bearing members.

An additional aim of the present invention is to ensure that, while detached, the adaptive implement remains correctly adjusted so that it may be reliably re-attached to the wheelchair and engaged in a position which confers optimal performance. In meeting these challenges together, embodiments of the present invention enable precise, repeatable alternating of the wheelchair between the original load-bearing mode during which the forward portion of the load carried by the wheelchair is fully supported by the primary caster wheels, and the modified load-bearing mode during which the forward portion of the load is at least partially supported by the ground-contacting adaptive implement.

It will be appreciated by persons skilled in the art that embodiments of the present invention further comprise features which facilitate securing and removal of the device and for carrying out the cyclic operation sequence by a diverse population of users exhibiting a broad range of abilities, especially regarding manual dexterity and upper body strength. Features included in embodiments of the invention, such as oversized quick-release lever handles, contoured knobs, push-buttons, and the like, for example, make it easier for individuals having reduced manual grip strength and sensation to be able to tighten a quick-release collar or to actuate a manipulable control switch associated with a load-transitioning mechanism.

Some embodiment configurations may be suitable for use by individuals capable of leaning down, from a seated position, and accessing lower portions of the wheelchair frame for attachment and detachment purposes, whereas alternate embodiment configurations may be needed by individuals who are more comfortable remaining in a substantially upright seated position. A user, for example, who is strong and flexible enough to reach down and secure a transitioning apparatus to a portion of the frame about 12 inches above the ground will likely enjoy the benefit of having a clamping-type transitioning apparatus wherein the entire device may be removed to minimize the weight of the wheelchair when the device is not needed. A user who prefers to remain seated upright, on the other hand, may find it more practical to configure her wheelchair with a non-removable mounting member capable of accepting an attaching member of the apparatus which is separable from the mounting member, the mounting member being semi-permanently secured to the frame of the wheelchair and disposed at a higher and more rearward location such as about three inches below the seat and about midway between the front of the frame and the front of the rear drive wheel.

For added convenience to the user, embodiments may include provisions for stowing adaptive implements behind or beneath the seat of the wheelchair while the wheelchair is in its original load-bearing configuration. Clamps, clips, perches, or other connectors may be utilized for the purpose of releasably securing adaptive implements at locations on the wheelchair which are unobtrusive and which are easy for the user to access.

Preferred embodiments are lightweight, compact, durable, and aesthetically appealing, which are exemplified by designs, components, construction methods and materials utilized in the bicycle industry and which have gained widespread use in adaptive wheelchair sports and recreation equipment. Modular design principles, such as standardization and partitioning, may be utilized to reduce manufacturing costs, increase the number of configuration options, and allow for proper, customized fitting to a wider range of makes and models of existing wheelchairs available in the marketplace.

Instructing a user may be accomplished by way of a paper or electronic manual containing a written description and/or illustration of the aforementioned sequence of operation to the user, whether packaged with the product, delivered in-person by a technician or sales representative, or delivered or transmitted separately through the mail or over the Internet. Further, use of video for the purpose of instructing the user may be especially helpful for conveying the steps involved, whether packaged with the product, delivered in-person by a technician or sales representative or delivered or transmitted separately such as with a video download through a company website or a third-party Internet video service. Instructing a user may further involve providing training, such as through in-service meetings or workshops, to physical therapists, medical staff members, or similar clinicians who are qualified to assist the user in the education process.

BRIEF DESCRIPTION OF THE DRAWINGS

The above-mentioned features of the invention will become more clearly understood from the following detailed description of the invention read together with the drawings in which:

FIGS. 1A-7 show a wheelchair occupant reconfiguring a wheelchair equipped with left and right ratcheting pawl-type transitioning mechanisms having forward-inserting couplings adapted to receive left and right caster wheel implements.

FIG. 6 is a close-up view showing the assembly of the manipulable biasing switch.

DETAILED DESCRIPTION OF THE DRAWINGS

The drawings described hereinafter are intended for the purpose of illustration rather than limitation.

To facilitate understanding of the figures, structural elements located on the right side of the wheelchair as well as any attachments thereto, from the perspective of an occupant of the wheelchair, have been labeled with the suffix "R" following the numeral corresponding to the structural element. Similarly, structural elements located on the left side of the wheelchair and any attachments thereto have been labeled with the suffix "L" following the numeral corresponding to the structural element. In cases where the aforementioned labeling convention does not aid in understanding a particular figure, the suffix has been omitted and only the numeral has been used. For example, the left-side rear drive wheel is referred to by label "120L," and the right-side rear drive wheel is referred to by label "120R"; however, in a side-view illustration wherein 120L cannot be visibly distinguished from 120R, the rear drive wheels are collectively referred to by using label "120."

Figure 1A:
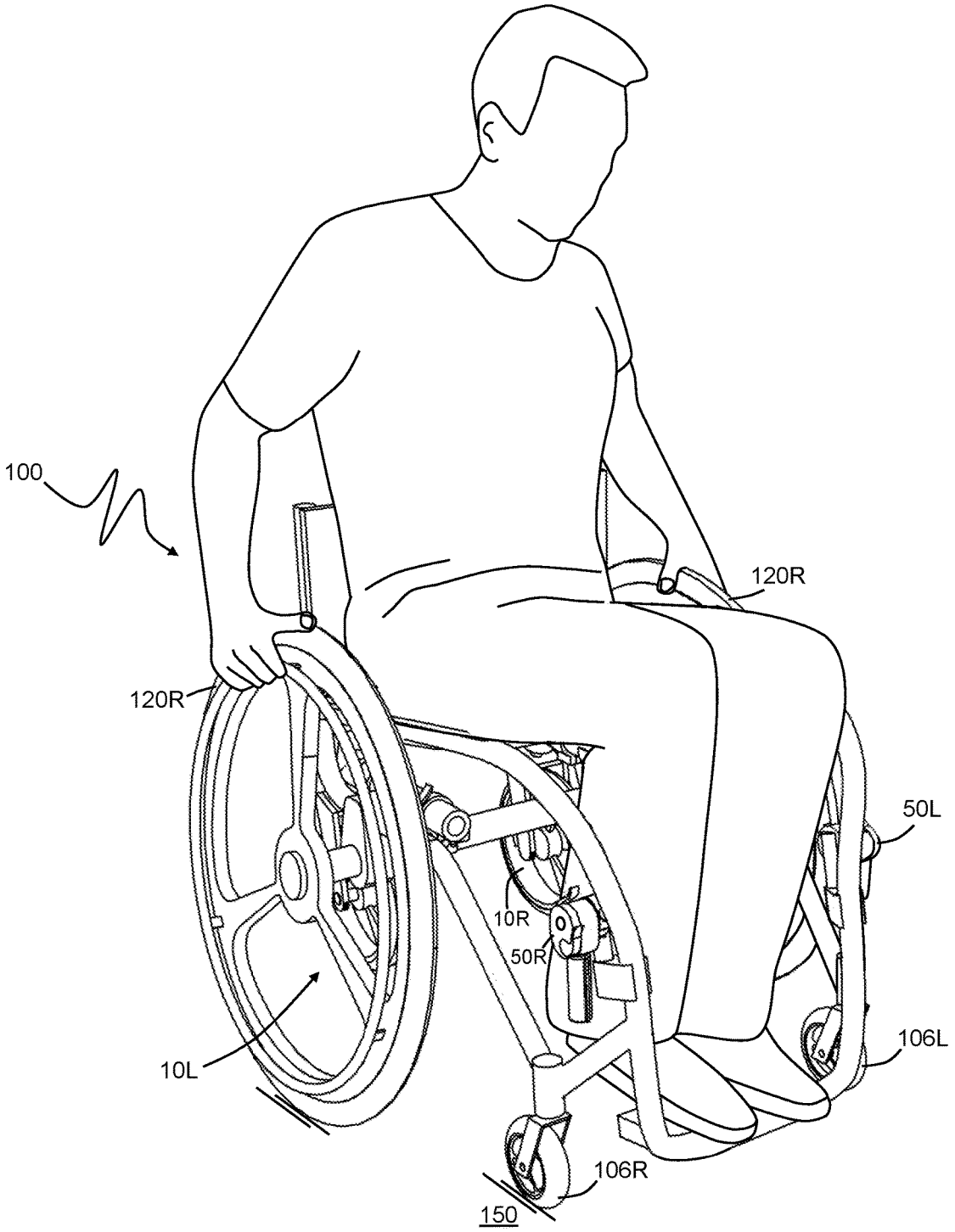
Figure 1B:
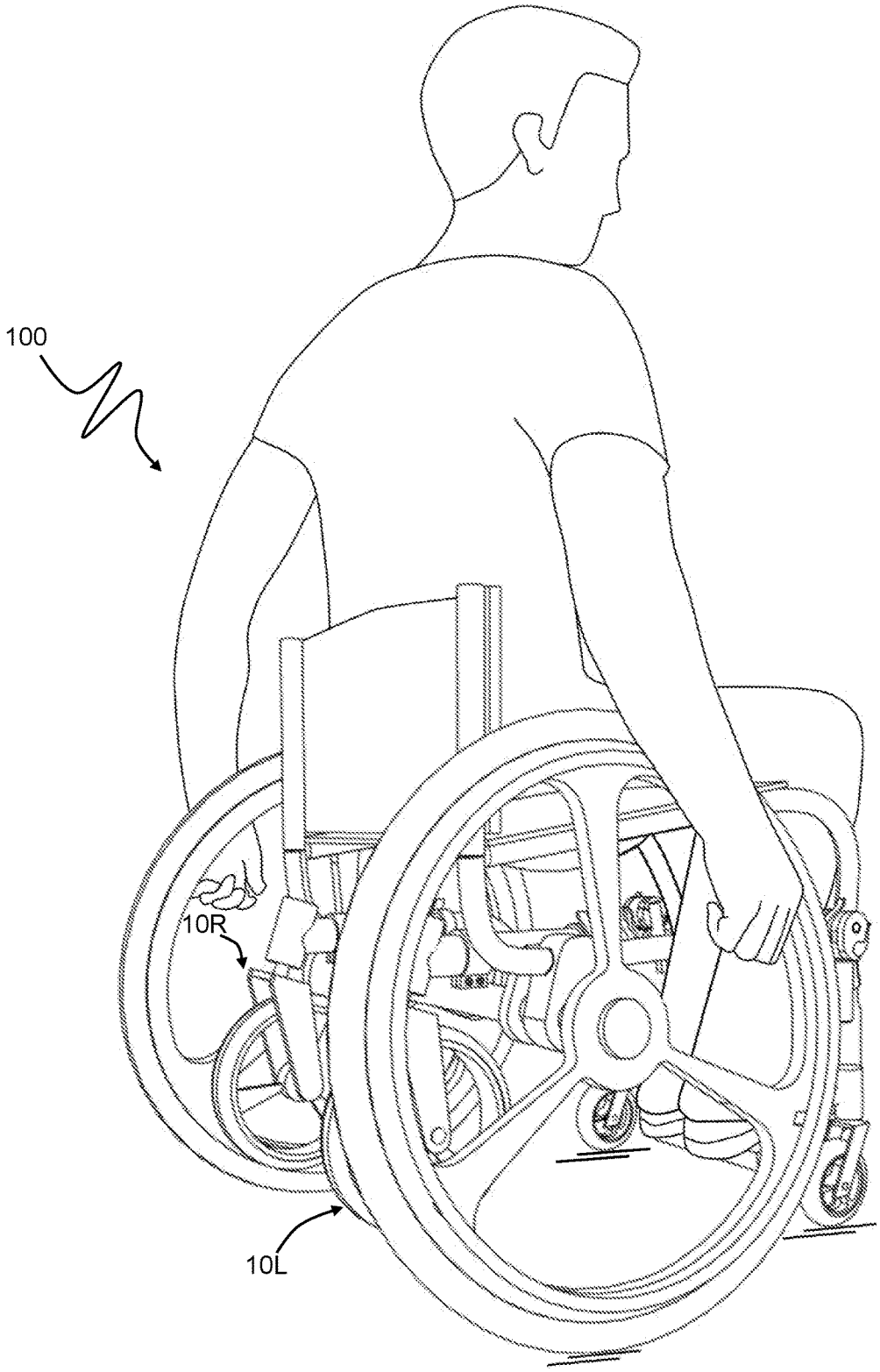

In FIG. 1A, the occupant is shown utilizing the wheelchair 100 while in its original, unadapted load-bearing configuration, having the rear drive wheels 120L and 120R and primary caster wheels 106L and 106R in contact with the ground surface 150. Ratcheting pawl-type transitioning mechanism assemblies 50L and 50R are shown semi-permanently affixed to opposing left and right forward regions of the wheelchair 100. Dual adaptive caster wheel implements 10L and 10R, stowed beneath the seat, are visible. FIG. 1B more clearly shows the stowed positioning of the adaptive caster wheel implements 10L and 10R, as visible from behind the wheelchair 100.

Figure 1C:
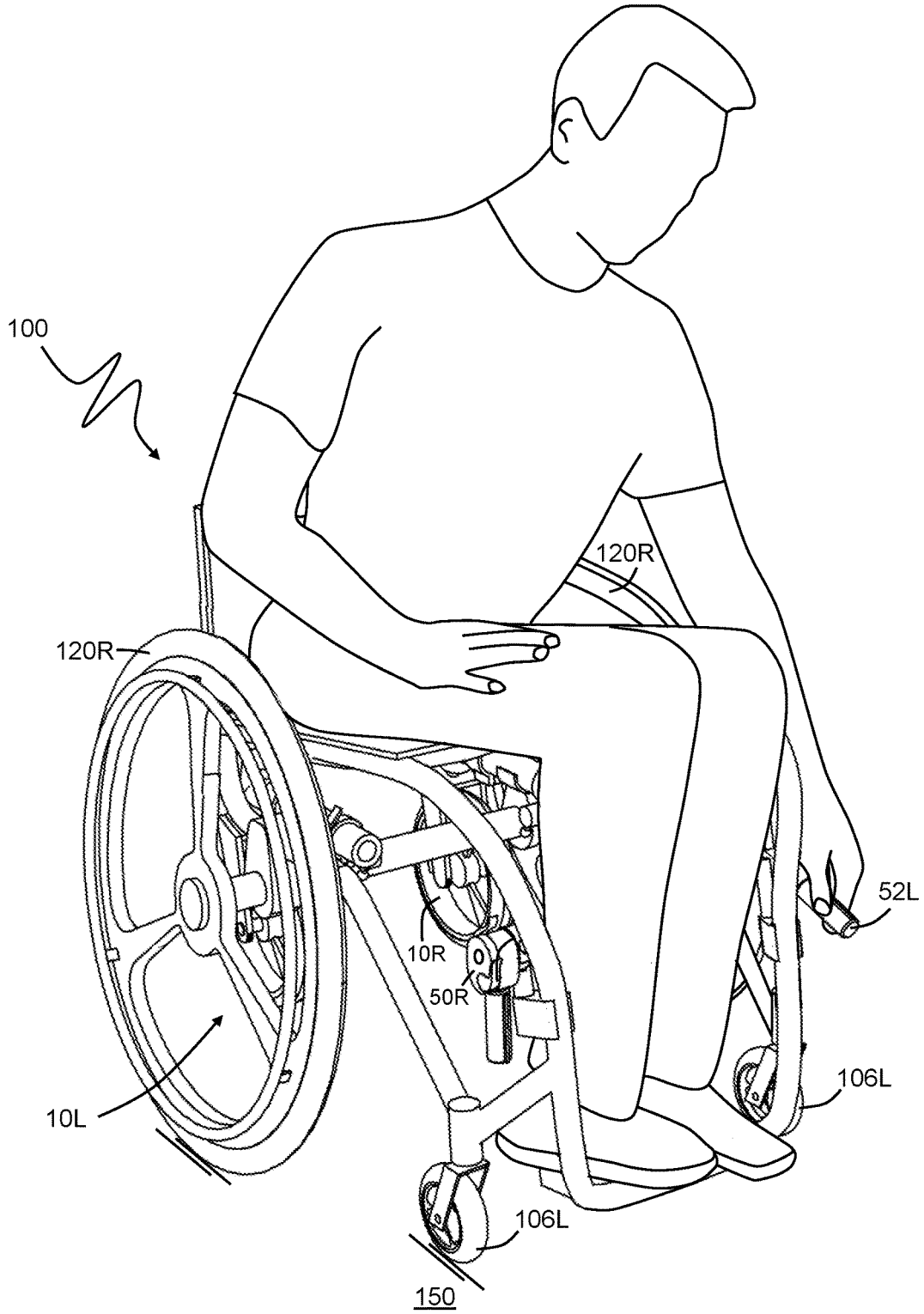

FIG. 1C shows the user positioning male coupling member 52L affixed to a rotatable portion of ratcheting pawl-type transitioning mechanism assembly 50L, in preparation for connecting adaptive caster wheel implement 10L thereto.

Figure 1D:
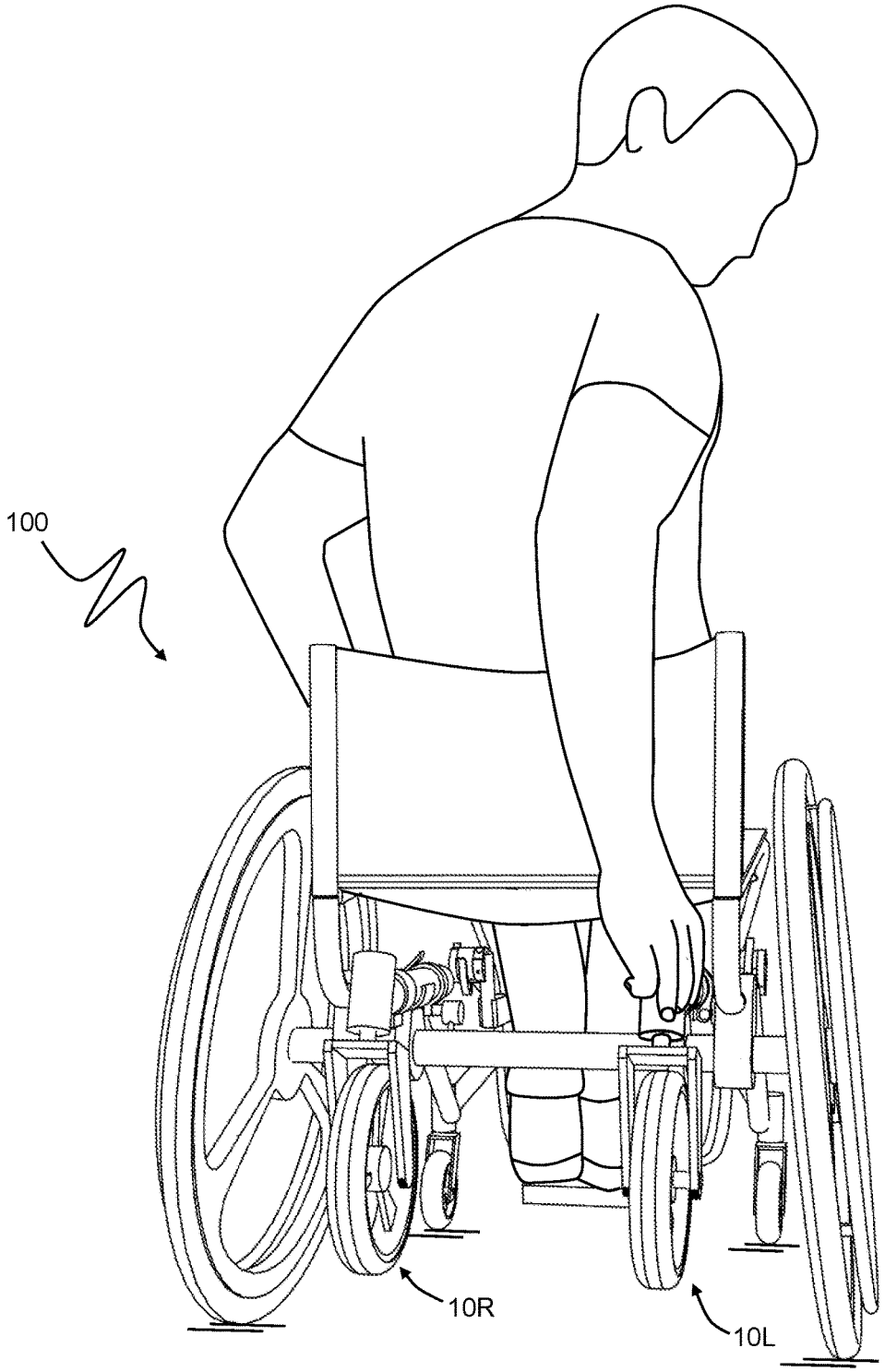

FIG. 1D shows the user reaching behind the wheelchair 100 to remove adaptive caster wheel implement 10L from its stowed position (on the right side, beneath the seat).

Figure 1E:
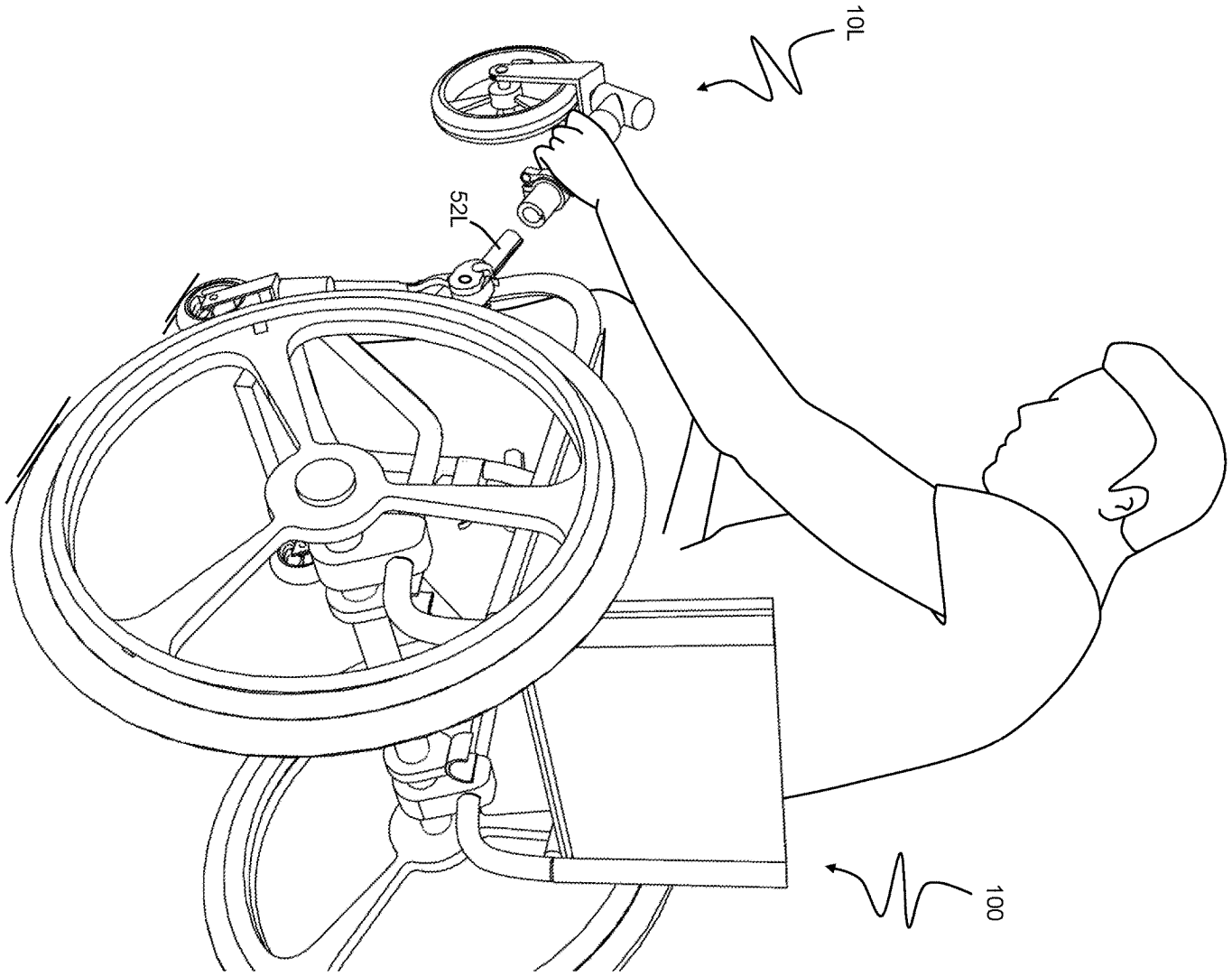
Figure 1F:
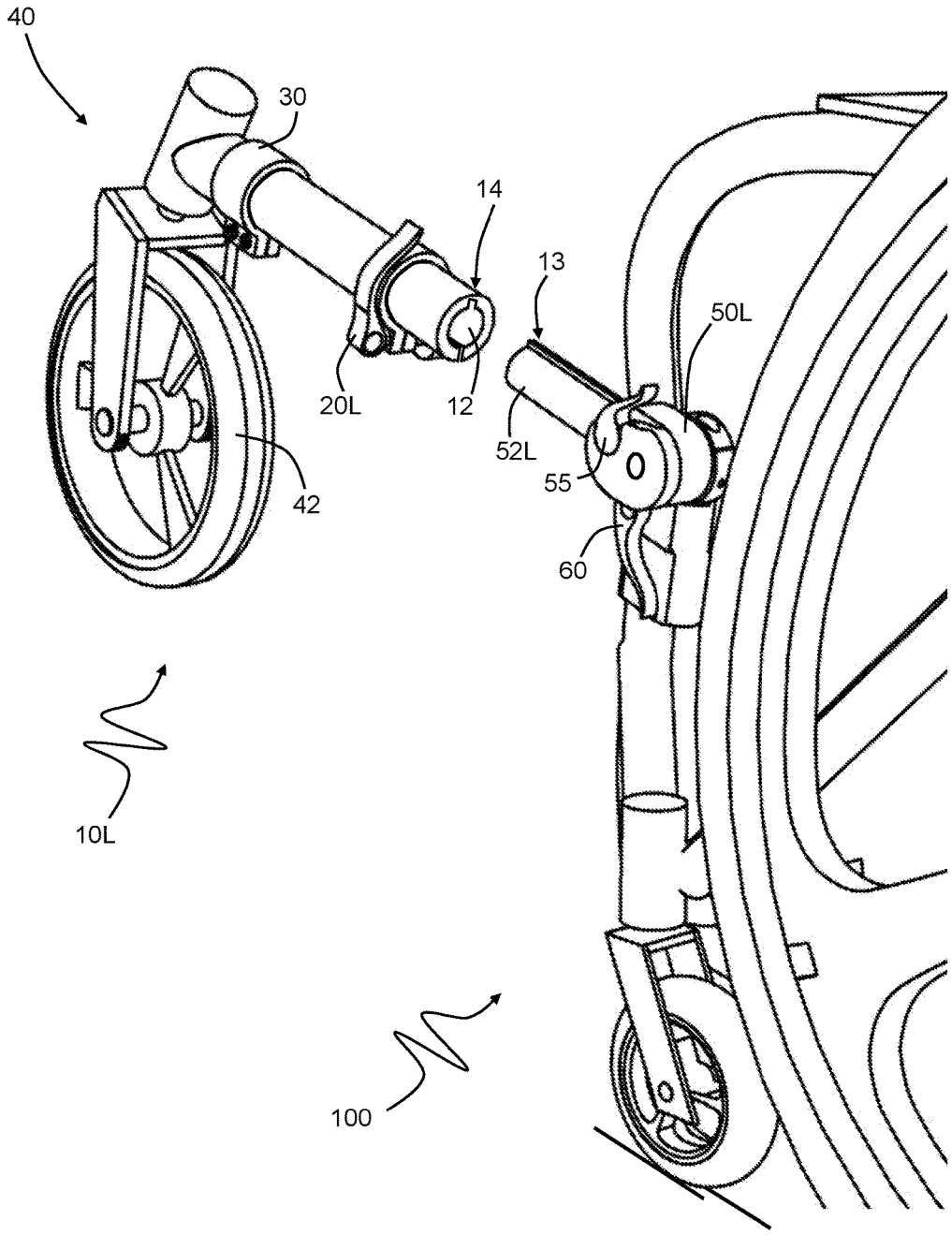

In FIG. 1E, the user is shown attaching adaptive caster wheel implement 10L to male coupling member 52L. FIG. 1F is an enlarged view showing the coupling relationship of the adaptive caster wheel implement 10L with the male coupling member 52L. Male coupling member 52L comprises anti-rotation key 13, which slides into keyway 14 notched into opening 12 at the end of adaptive caster wheel implement 10L.

Also shown in FIG. 1F are quick-release clamping collar 20 and adjustment collar 30. Adjustment collar 30 is used to adjust the "roll" axis of caster wheel assembly 40 so that it trails properly while deployed. Quick-release clamping collar 20 enables the user to releasably secure the adaptive caster wheel implement 10L to the male coupling member 52L after sliding the opening 12 thereover.

Also visible in FIG. 1F is biasing switch lever 55, which is operatively connected to the internal transitioning mechanism for the purpose of biasing a movable pawl bearing toward and away from engagement with a bearing surface. Additionally, FIG. 1F shows binding cam subassembly 60 having lever arm 62 which is operatively connected to a tensioning skewer projecting internally to the internal transitioning mechanism for the purpose of enabling the user to releasably draw the movable pawl bearing into a position of maximum binding engagement with the bearing surface.

Not visible in FIG. 1F, but readily visible in FIGS. 1G-13 is external cam binding assembly 70 affixed to quick-release clamping collar 20 for the purpose of enabling the user to establish binding force between the wheelchair frame and the adaptive caster wheel implement 10L to further unify the caster wheel implement 10L with the wheelchair. Alternatively, an additional clamp may be used in place of external cam binding assembly 70 to similarly unify the caster wheel implement 10L with the wheelchair.

Figure 1G:
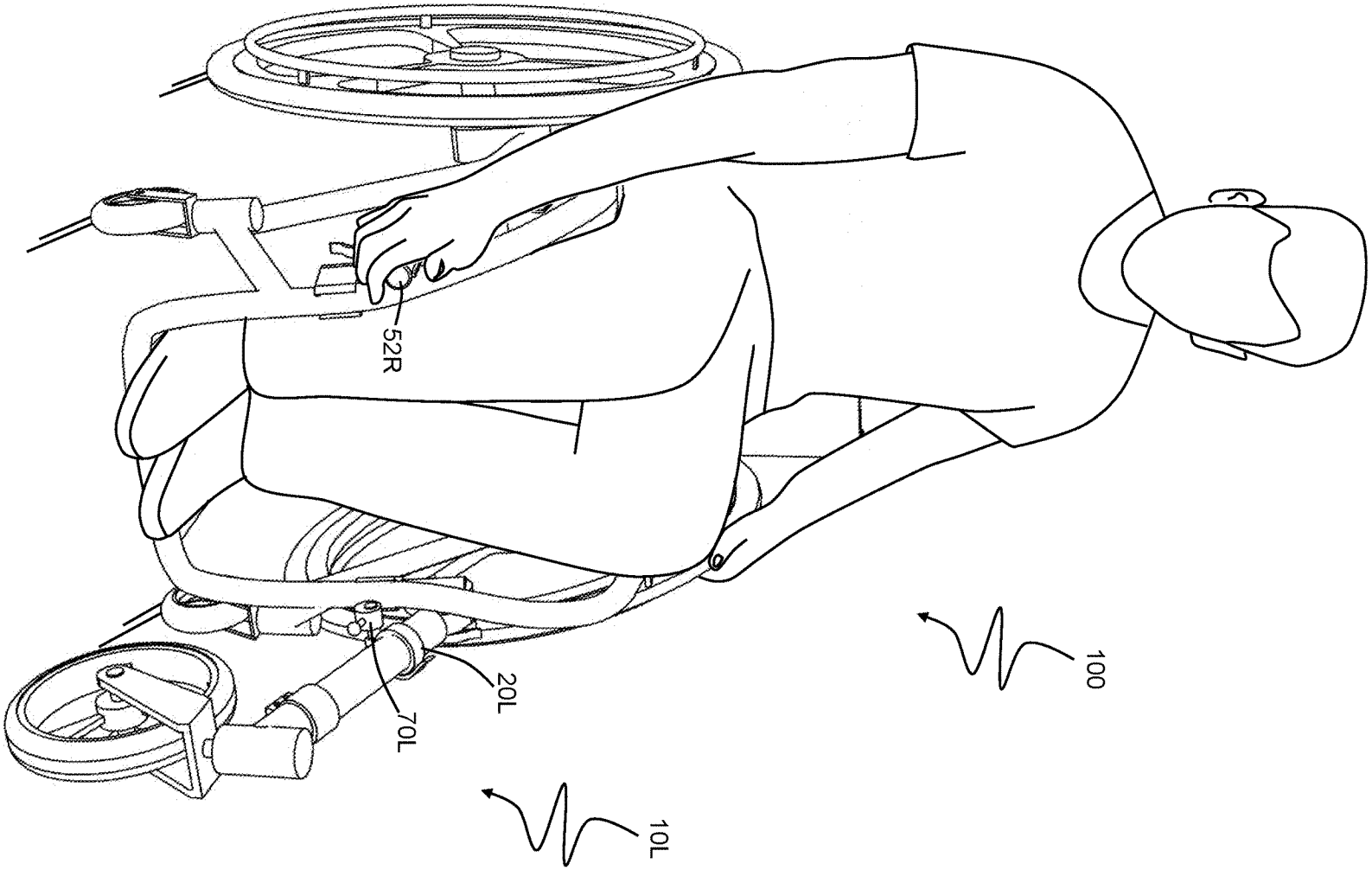

In FIG. 1G the user prepares the right-side male coupling member 52R for receiving the right-side adaptive caster wheel implement 10R (not visible).

Figure 1H:
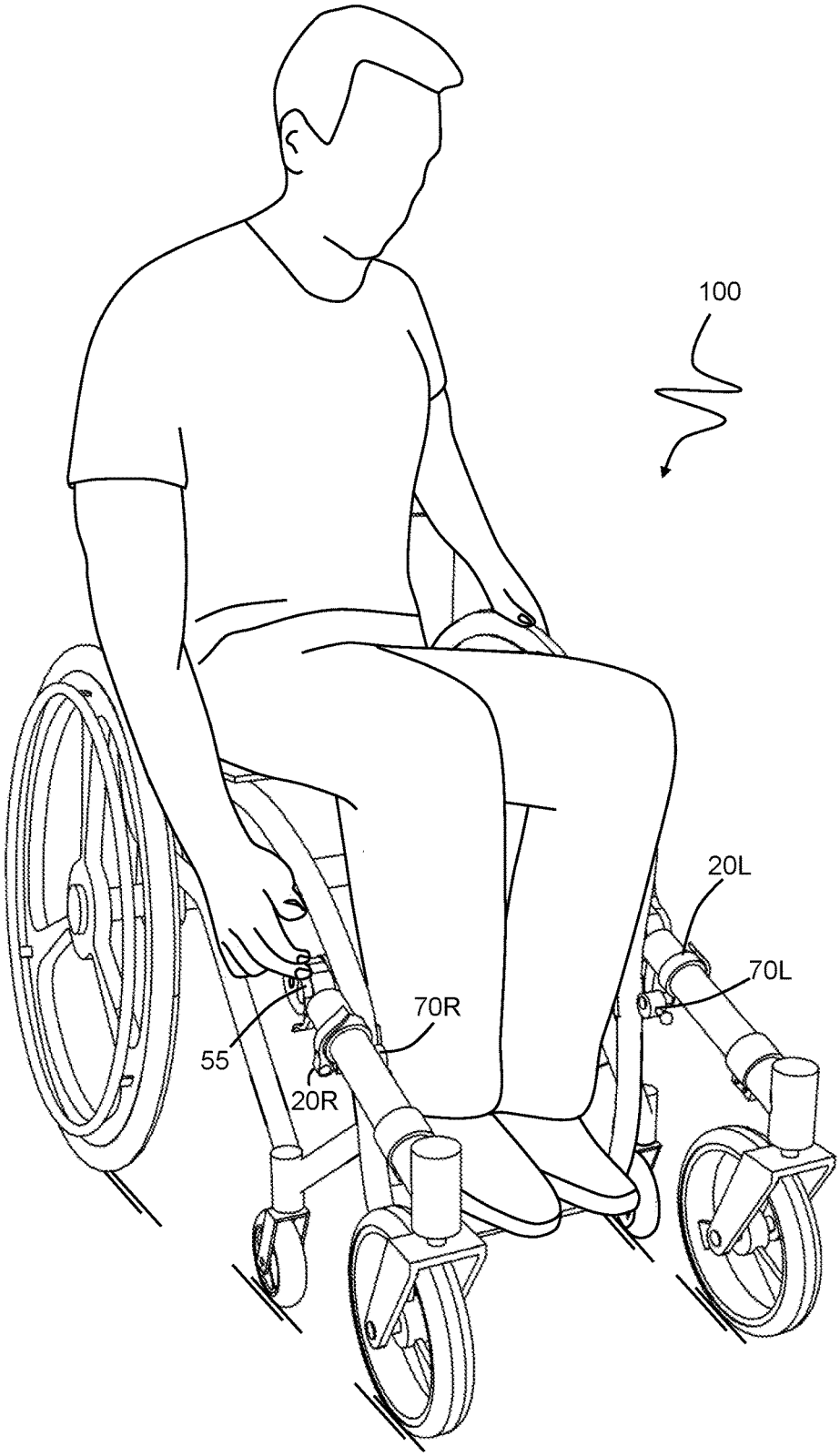

FIG. 1H shows the user manipulating the biasing switch lever 55 to place the load transitioning mechanism into the pre-deployment stage of operation, after which time the user performs the wheel-stand maneuver (shown in FIG. 1-I), effectuating the transition to the deployment stage of operation wherein the primary caster wheels 106L and 106R are elevated from contact with the ground surface.

Figure 1J:
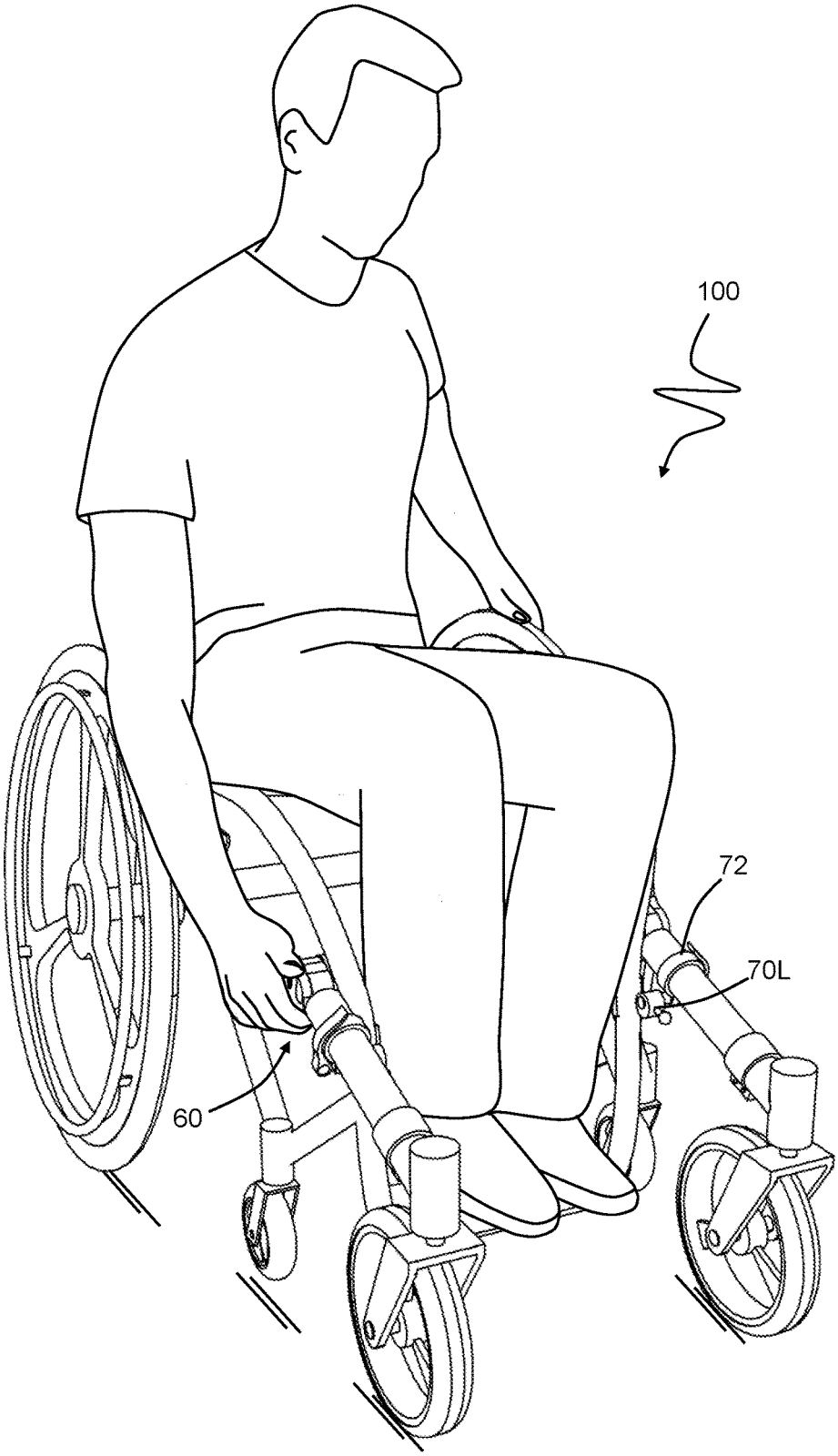

In FIG. 1J, the user is shown manipulating the binding cam lever arm 62 while the load transitioning mechanism is in the deployment stage of operation. Also, at this time, the user may rotate the external cam binding assembly 70 affixed to quick-release clamping collar 20 to establish additional binding force between the wheelchair frame and the adaptive caster wheel implement 10L to further unify the caster wheel implement 10L with the wheelchair.

Figure 2A:
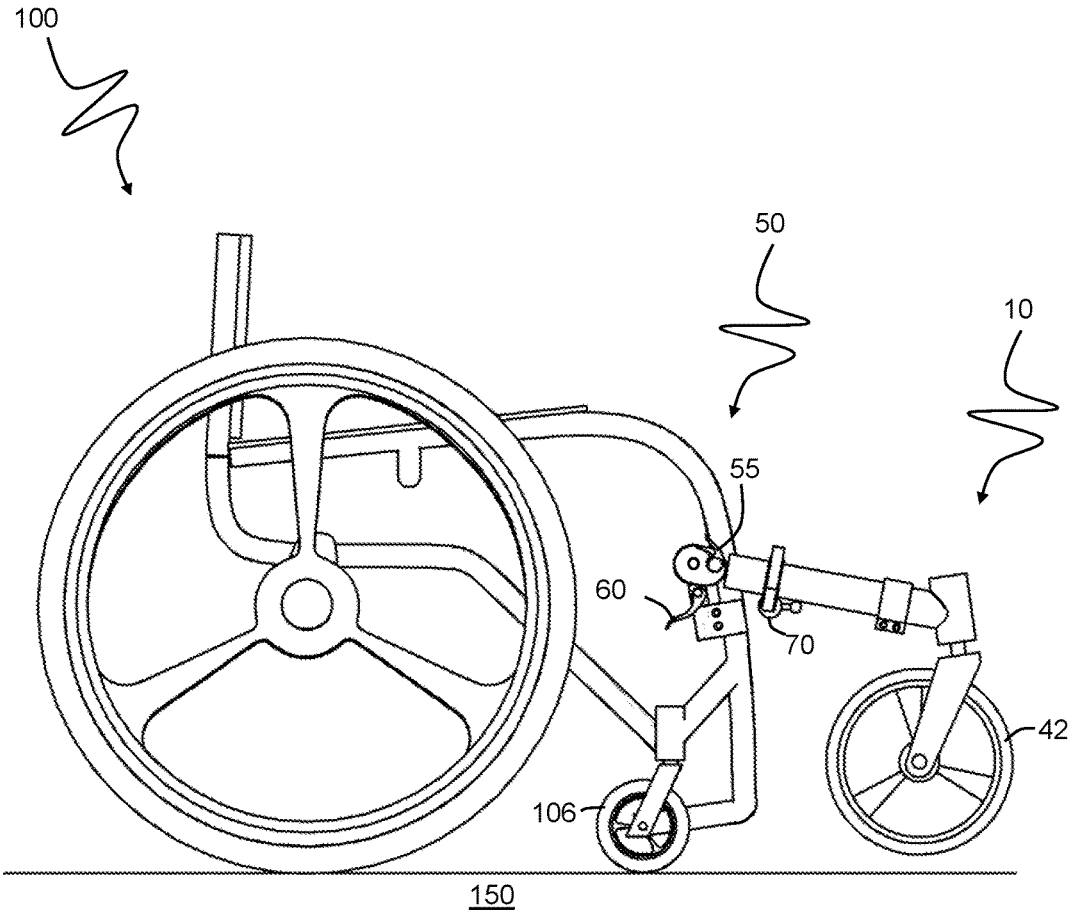
FIGS. 2A-F are side views of the wheelchair equipped with ratcheting pawl-type transitioning mechanisms during the cyclic operation sequence, including steps for actuating additional binding means.

FIG. 2A shows a side view of the wheelchair 100 equipped with ratcheting pawl-type transitioning mechanism 50 during the attach/release stage of the cyclic operation sequence. The pawl-type transitioning mechanism 50 comprises biasing switch lever 55 in its forward (disengaging) position, binding cam lever arm 62 in its unbound position, and external cam binding assembly 70 in its unbound position. Coupled with the pawl-type transitioning mechanism 50 is adaptive caster wheel implement 10 having caster wheel 42 elevated from contact with the ground surface 150, as it is free to rotate in both the upward and downward directions without any engagement occurring within the mechanism. The mechanism is thus in the attach/release stage of the operation sequence.

Figure 2B:
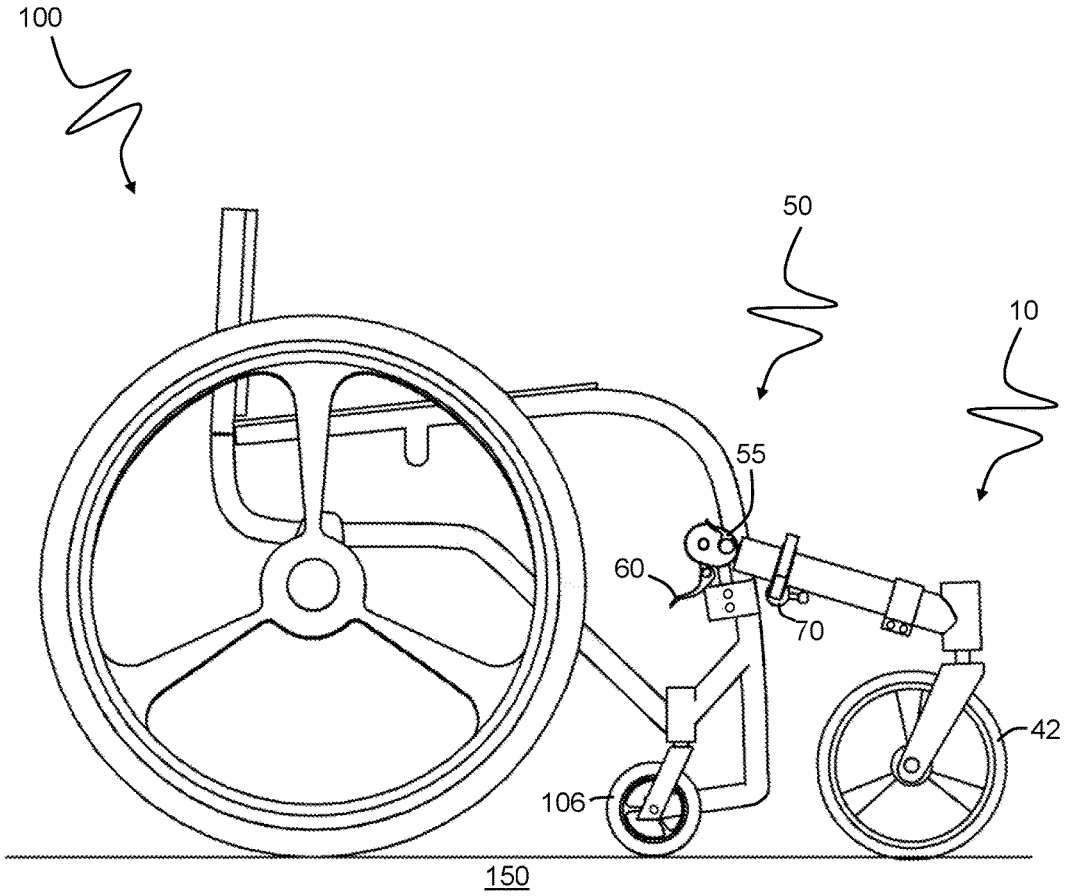

In FIG. 2B, the pawl-type transitioning mechanism 50 is shown in the pre-deployment stage of the operation sequence, now having the biasing switch lever 55 oriented in its rearward (engaging) position. The caster wheel 42 is contacting the ground surface 150 as a result of the user allowing the adaptive caster wheel implement 10 to rotate downward about the joint axis of the pawl-type transitioning mechanism.

Figure 2C:
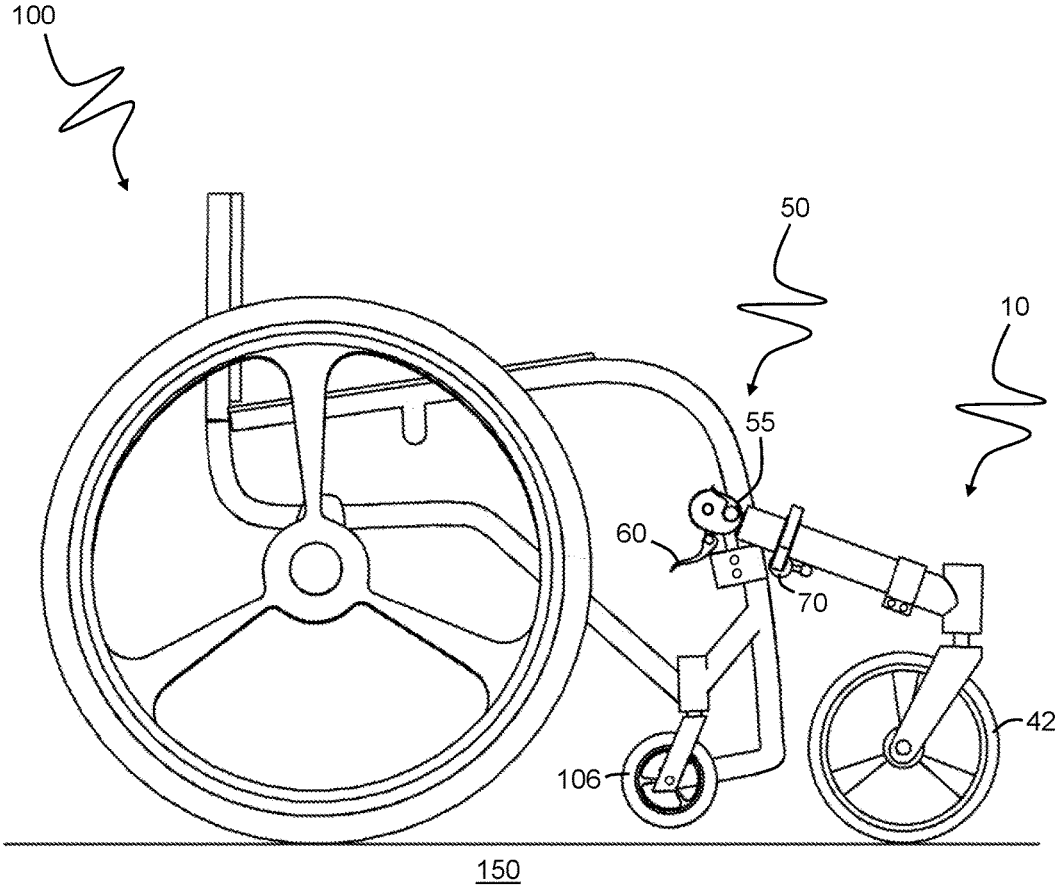

Upon the user performing the wheel-stand maneuver, the pawl-type transitioning mechanism 50 enters the deployment stage of the operation sequence, shown in FIG. 2C, wherein the adaptive caster wheel implement 10 bears the forward portion of the load carried by the wheelchair and wherein the primary caster wheels 106 of the wheelchair 100 remain elevated from contact with the ground surface 150.

Figure 2D:
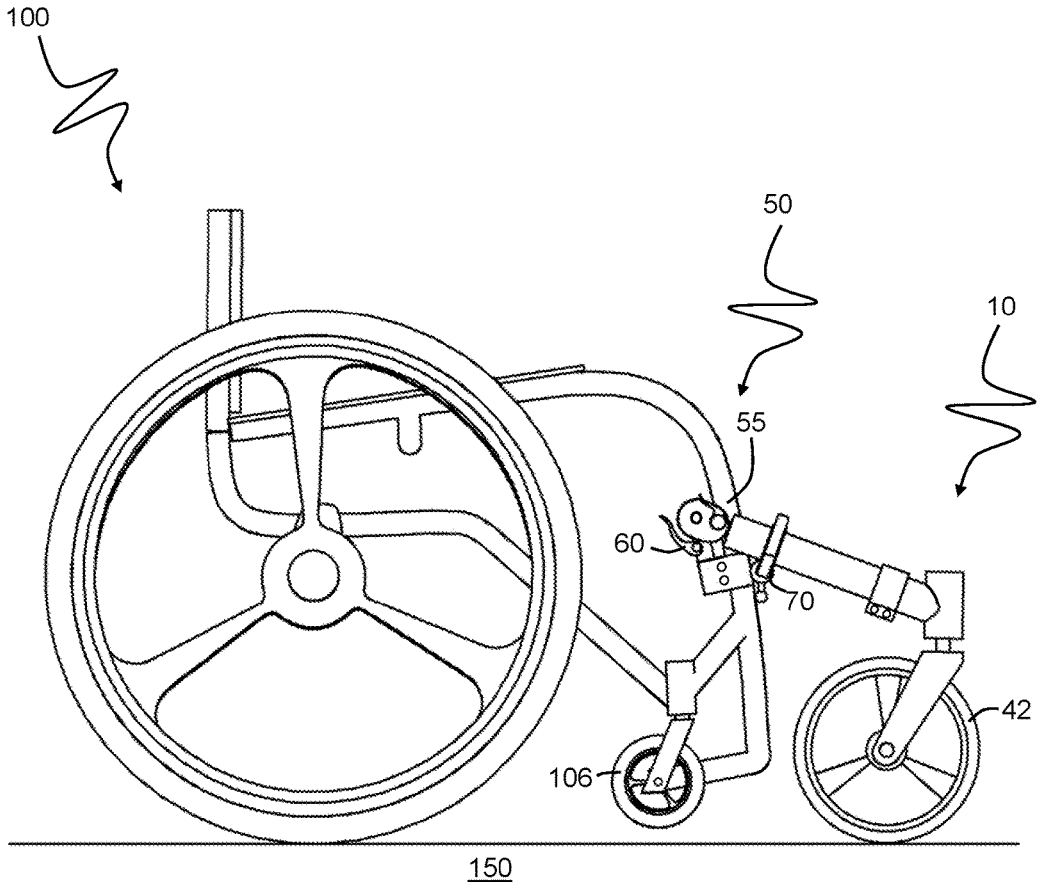

In FIG. 2D, the wheelchair 100 is shown in the modified load-bearing configuration while also having the binding cam lever arm 62 in its bound position and while also having the external cam binding assembly 70 in its bound position, for rigidly unifying the adaptive caster wheel implement 10 with the frame of the wheelchair 100. In other words, the mechanism is in the deployment stage of the operation sequence in conjunction with enhanced binding capabilities.

Figure 2E:
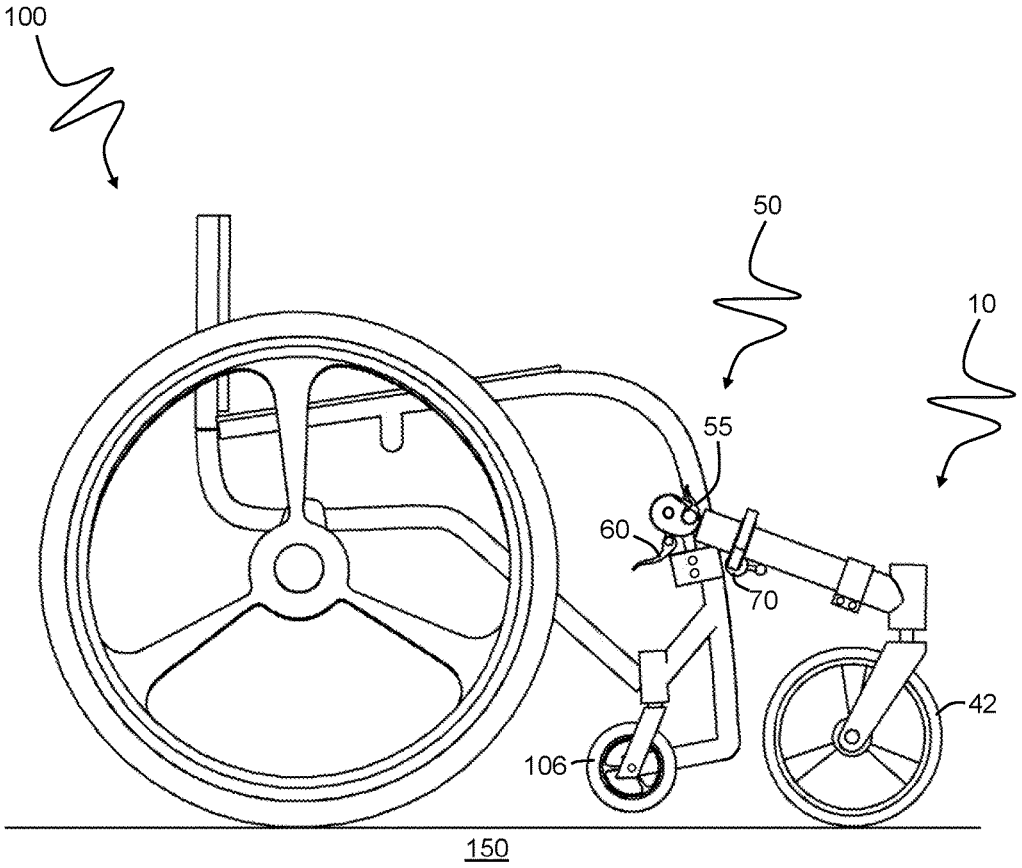

FIG. 2E shows the wheelchair 100, still in the modified load-bearing configuration while now having the binding cam lever arm 62 in its unbound position and while also having the external cam binding assembly 70 in its unbound position, for releasing the adaptive caster wheel implement 10 from its rigid unification with the frame of the wheelchair 100. Further, the biasing switch lever 55 is oriented in its forward (disengaging) position, in preparation for the user to perform the wheel-stand maneuver to effectuate alternating the wheelchair from the modified load-bearing configuration to the original load-bearing configuration. The mechanism, as depicted in FIG. 8E, is thus in the pre-release stage of the operation sequence.

Figure 2F:
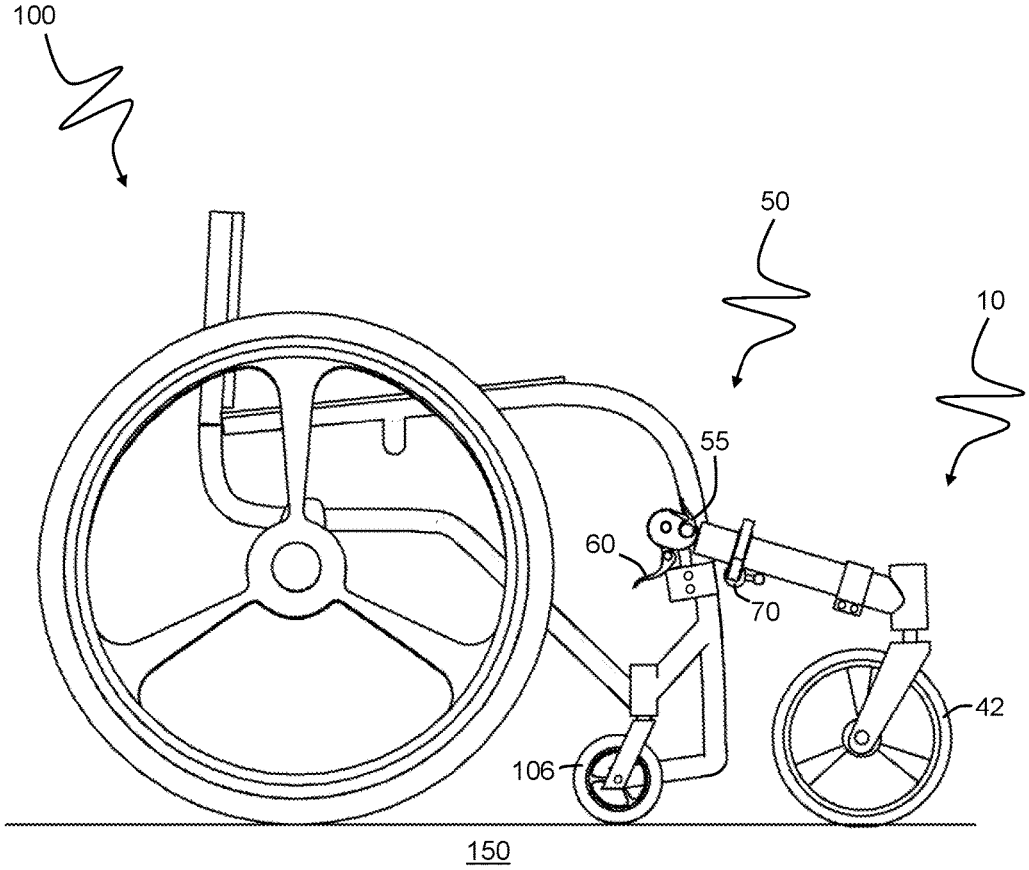

FIG. 2F shows the wheelchair 100 after the user has performed the wheel-stand maneuver to alternate the wheelchair from the modified load-bearing configuration to the original load-bearing configuration; the mechanism is returned to the attach/release stage of the operation sequence. At this stage, the user may now lift the adaptive caster wheel implement 10 so that it rotates upward about the joint axis of the pawl-type transitioning mechanism 50, after which the user may de-couple the adaptive caster wheel implement 10 from the wheelchair 100 and return it to a stowed position, if desired.

Figure 3A:
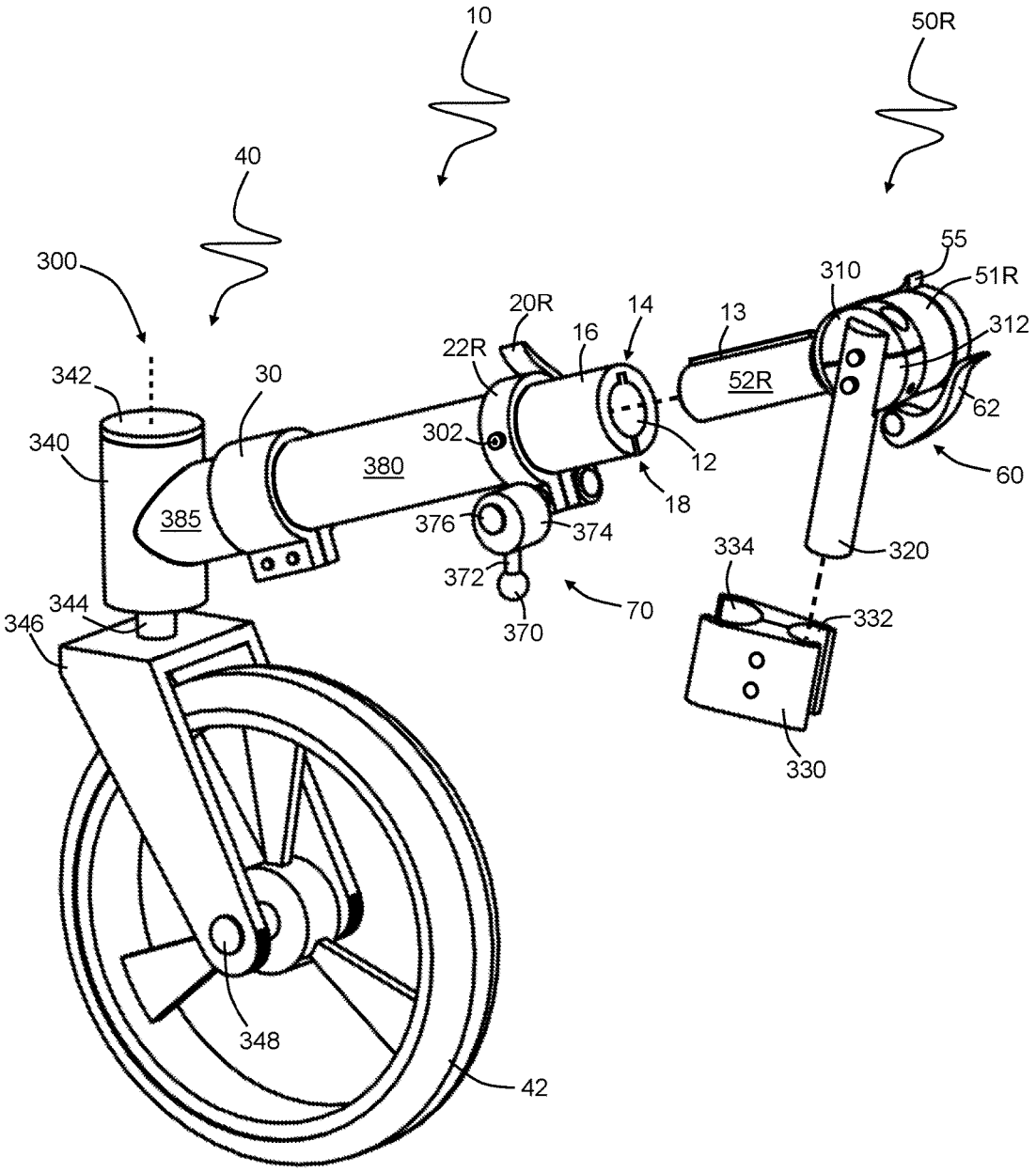
FIGS. 3A and 3B depict the coupling relationship of the right-side caster wheel implement and the right-side ratcheting pawl-type transitioning mechanism.
Figure 3B:
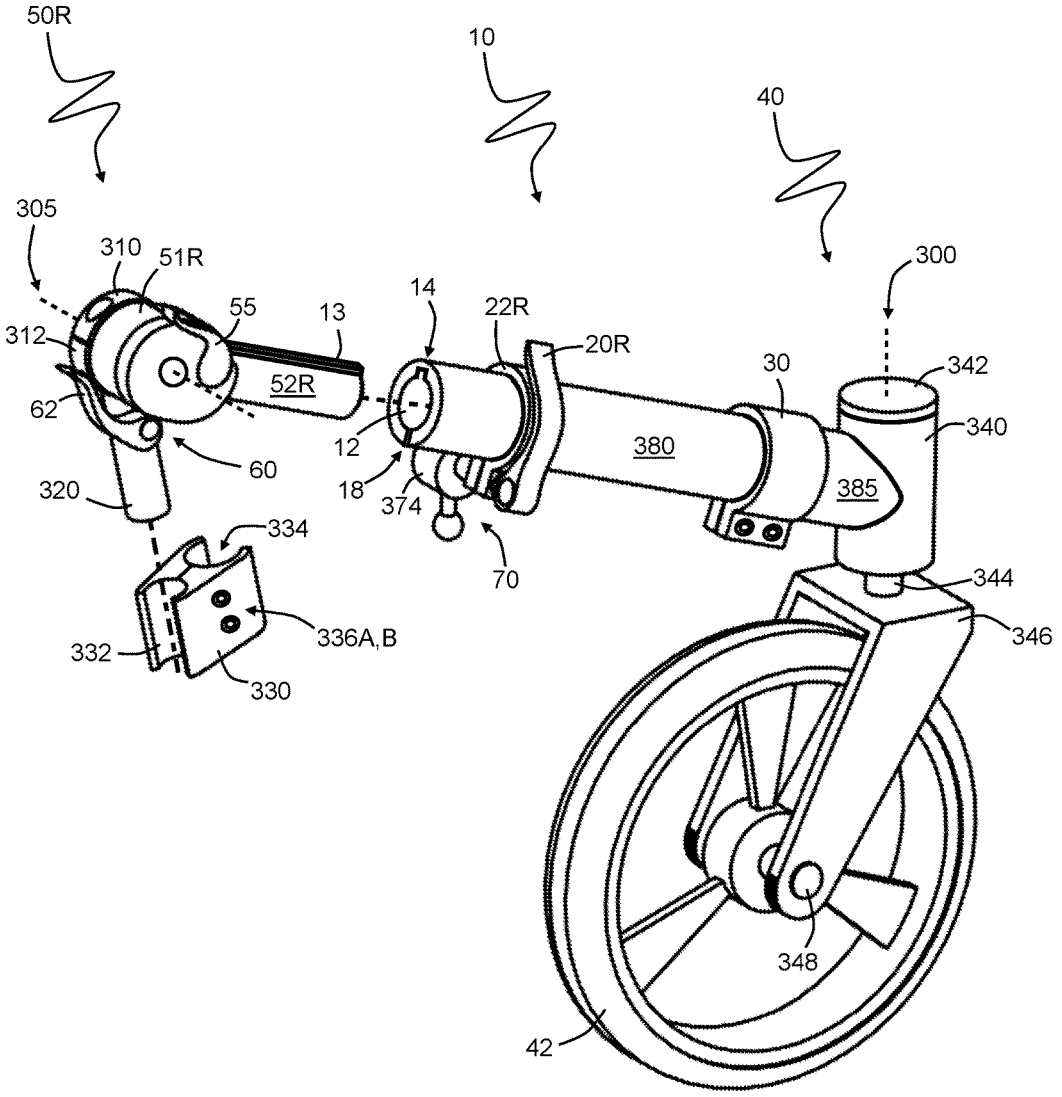

FIGS. 3A and 3B illustrate the insertion path of right-side male coupling member 52R as end receiver opening 12 of the adaptive caster wheel implement 10 slides over right-side male coupling member 52R. Disposed along the length of right-side male coupling member 52R is anti-rotation key 13 adapted to fit into keyway 14 of end receiver opening 12. Male coupling member 52R is rigidly unified with the casing 51R and serves as a movable joint member which is rotatable relative to cylindrical connector shaft 320. Cylindrical connector shaft 320 serves as a fixed joint member which is affixed to the frame of the wheelchair using parallel tube clamp 330 for unifying cylindrical connector shaft 320 and the torque cylinder (not visible) connected thereto and contained within the casing 51R of the right-side pawl-type transitioning mechanism 50R. Cylindrical connector shaft 320 is bolted to the torque cylinder (not visible) and screwed to lower torque clamp member 312. Upper torque clamp member 310 is bolted to lower torque clamp member 312, wherein the two serve to rigidly fasten the cylindrical connector shaft 320 to a square portion of the torque cylinder (not visible).

FIGS. 3A and 3B also show how the pawl-type transitioning mechanism 50 is adapted for attachment to a tubular frame of a wheelchair, as cylindrical connector shaft 320 fits into semi-cylindrical recess 332 of parallel tube clamp 330. Parallel tube clamp 330 also comprises a second semi-cylindrical recess 334 dimensioned according to the outer diameter of the frame tube of the wheelchair over which it is secured by tightening clamp bolts 336A and 336B. Alternatively, the parallel tube clamp 330 may be dimensioned to tighten around a cylindrical adapter shim (not shown), wherein one of a selection of cylindrical adapter shims is chosen, thereby enabling accommodation for a selection of common frame tube outer diameter, such as 1.0 inches, 1.125 inches, 1.25 inches, 1.375 inches, or 1.5 inches.

Upon coupling the right-side male coupling member 52R with the end receiver opening 12, cam-action quick-release tube clamp 22R having lever arm 20R is utilized to apply constrictive clamping force, around the end receiver 16 having slit 18, when lever arm 20R is positioned in its upright position as shown in FIGS. 3A and 3B. Constrictive clamping force maintained around the end receiver 16 by tube clamp 22R secures the end receiver 16 to the male coupling member 52R.

End receiver 16 is integrated with tubular extension arm 380, whether by way of welding or use of fastening means such as a bolt, machine screw, set screw, or the like; FIG. 3A shows machine screw 382 penetrating a collar portion of cam-action quick-release tube clamp 22R to rotationally unify the tube clamp 22R, the tubular extension arm 380, and the end receiver 16.

External rotation-limiting detent assembly 70, comprising manipulable knob 370, lever 372, cam body 374, and shaft 376 is integrated with cam-action quick-release tube clamp 22R and is positioned such that cam body 374 will contact a forward portion of the wheelchair frame during deployment of the apparatus (with the wheelchair in the modified load-bearing configuration). In other words, external rotation-limiting detent assembly 70 serves to limit the degree of downward rotation of the rotatable portion of the apparatus about the axis of rotation passing through the joint formed by the load-transitioning mechanism 50.

Upon attaching the adaptive caster wheel implement 10 to the load-transitioning mechanism 50 and subsequently transitioning the load-transitioning mechanism 50 to the deployment stage, the user may add further rigidity to the connection between the deployed apparatus and the frame of the wheelchair; this may be accomplished by utilizing an internal cam-binding subassembly 60 integrated with the mechanism contained within the casing 51R and also by utilizing the tensioning action which may be imposed against the frame of the wheelchair by rotating cam body 374 about cam shaft 376. Tension is imparted between cam body 374 and the frame as a result of rotating knob 370 attached to the end of lever 372, wherein the apparatus is effectively pushed in the direction away from the frame, thereby eliminating any vibration or wiggle therebetween and adding rigidity to the overall connection. An alternative means envisaged herein, to achieve a similar result, is to replace the cam body 374 and associated knob 370 and lever 372 with a releasable collar or similarly-functioning element adapted, instead, for drawing the apparatus tightly against the frame of the wheelchair for eliminating vibration or wiggle and adding rigidity to the overall connection.

Distally attached to tubular extension arm 380 is caster assembly 40. Caster assembly 40 comprises attachment arm 385, caster cylinder 340 which houses pivot bearings (not visible) which have holes which receive pivot shaft 344 projecting up from caster fork 346 and into caster cylinder 340. Dust cover 342 prevents debris and moisture from entering caster cylinder 340. Adjustment collar 30, which rotationally and longitudinally secures attachment arm 385 to tubular extension arm 380, is also used to adjust the "roll" axis of caster wheel assembly 40 so that the wheel 42, which is rotatably held within the caster fork 346 by axle 348, rotates about a rotation axis passing centrally through the axle, and the wheel trails behind the pivot axis 300 during deployment as the user motivates the wheelchair in any desired direction. Bolts 390A and 390B are used to tighten adjustment collar 30 around the tubular extension arm 380 and the attachment arm 385.

Biasing switch lever 55 is shown in a rearward position, corresponding to an internal mechanism state in which sustained engaging force is applied to a movable pawl bearing to enable the load transitioning mechanism for transitioning to the deployment stage of operation. Rotating the biasing switch lever 55 so that it rests in a forward position corresponds to an internal mechanism state in which sustained engaging force is removed from the movable pawl bearing, at which point the load transitioning mechanism 50 becomes enabled to rotate freely in either direction about rotation axis 305 shown in FIG. 3B.

Figure 4A:
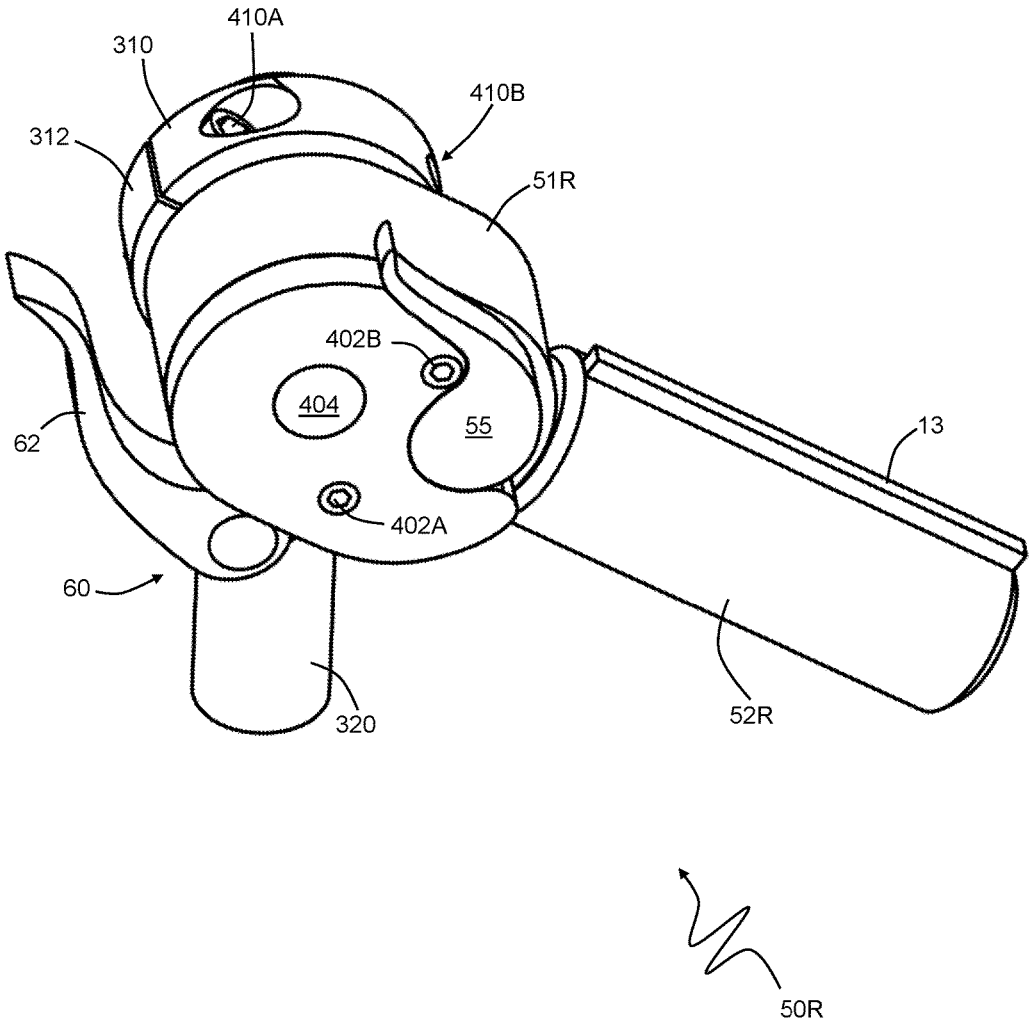
FIGS. 4A and 4B are views showing the external and internal construction of the right-side ratcheting pawl-type transitioning mechanism

FIG. 4A is a close-up view of the right-side load transitioning mechanism 50R. Male coupling member 52R, having anti-rotation key 13, is unified with casing 51R. Also unified with casing 51R is outer faceplate 400, through which machine screws 402A and 402B project to thread into the back side (not visible) of casing 51R to effectively draw outer faceplate 400 tightly against casing 51R. Biasing switch lever 55 is shown in a rearward position, corresponding to an internal mechanism state in which sustained engaging force is applied to a movable pawl bearing contained inside the casing 51R. Dust cap 404 covers a hole drilled through outer faceplate 400; removal of dust cap 404 allows access to a bolt projecting along the rotation axis 305 and passing centrally through the load transitioning mechanism 50R. Binding cam lever arm 62 is shown maintained in its bound position by frictional forces between cam lever arm 62 and a cam spacer 64 (visible in FIG. 4B) wherein maximum binding force is applied to the movable pawl bearing contained inside the casing 51R, effectively rigidizing the joint formed by the load transitioning mechanism 50R so that no relative movement occurs between the male coupling member 52R and the cylindrical connector shaft 320 as torque is applied about the rotation axis 305. FIG. 4A also shows the construction of the upper torque clamp member 310 and the lower torque clamp member 312 connected by bolts 410A and 410B.

Figure 4B:
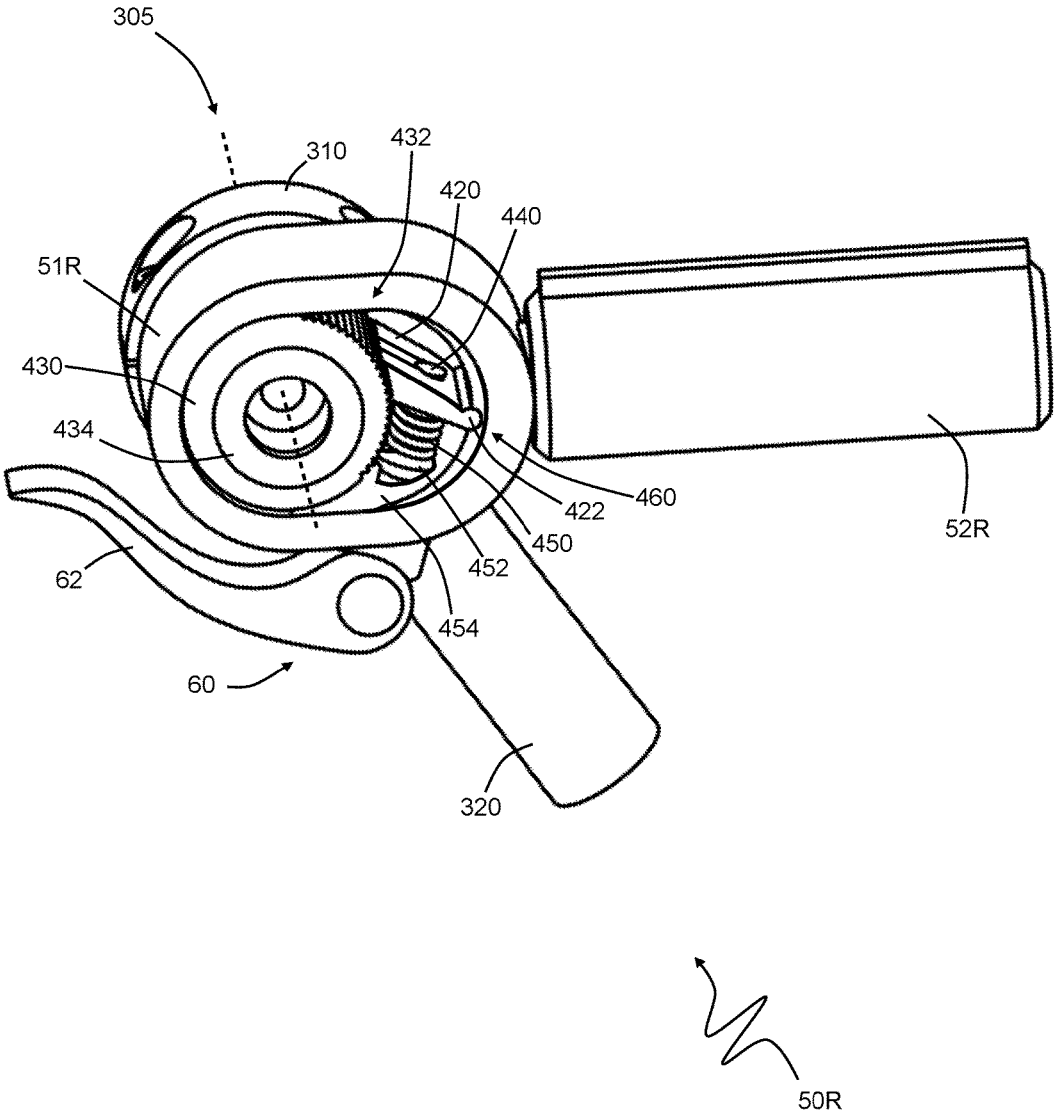

FIG. 4B shows a view similar to 4B, but absent outer faceplate 400 and inner faceplate (to be presented in FIGS. 5A and 5B) to show the internal components of the right-side load transitioning mechanism 50R. Lip 434 of torque wheel 430 is dimensioned to project through a circular aperture of an inner faceplate (to be presented in FIGS. 5A and 5B) which covers and encloses the internal components within the casing 51R. Pawl bearing 420, composed of alloy steel, hardened steel, aluminum bronze, or other suitable high-strength bearing material, has cylindrical end region 422 seated within bearing seat 460 which has been bored into casing 51R, movable pawl bearing 420 being rotatable about an axis passing longitudinally through the center of bearing seat 460.

It should be noted that pawl bearing 420 serves to transmit torque about joint axis 305 between the rotatable joint portion of load transitioning mechanism 50 formed by casing 51 and male coupling member 52 and the fixed joint portion of the load transitioning mechanism 50 formed by the cylindrical connector shaft 320 and torque wheel 430. Toothed contact region 432 of torque wheel 430 serves as a first bearing surface and bearing seat 460 bored into the casing 51 serves as a second bearing surface, wherein pawl bearing 420 is adapted to move into and out of a position of load-bearing engagement between the first bearing surface (toothed contact region 432) and the second bearing surface (bearing seat 460).

As in FIG. 4A, FIG. 4B shows binding cam lever arm 62 in its bound position wherein maximum binding force is applied to the movable pawl bearing 420 contained inside the casing 51R, which draws movable pawl bearing 420 tightly against the toothed contact region 432 of torque wheel 430. Pulling force effectuated by rotating the binding cam lever arm 62 to its bound position draws binding skewer 440 downward, in turn rotating movable pawl bearing 420 downward, thereby compressing disengagement spring 450 against flanged washer 452 which nests against the inner wall of casing 51R and which projects into aperture 454. Rotating the binding cam lever arm 62 downward (to its unbound position) releases binding skewer 440 to permit movable pawl bearing 420 to move away from contact against the toothed contact region 432 of torque wheel 430 due to sustained force applied by the disengagement spring, at all times, against the movable pawl bearing 420.

Figure 5A:
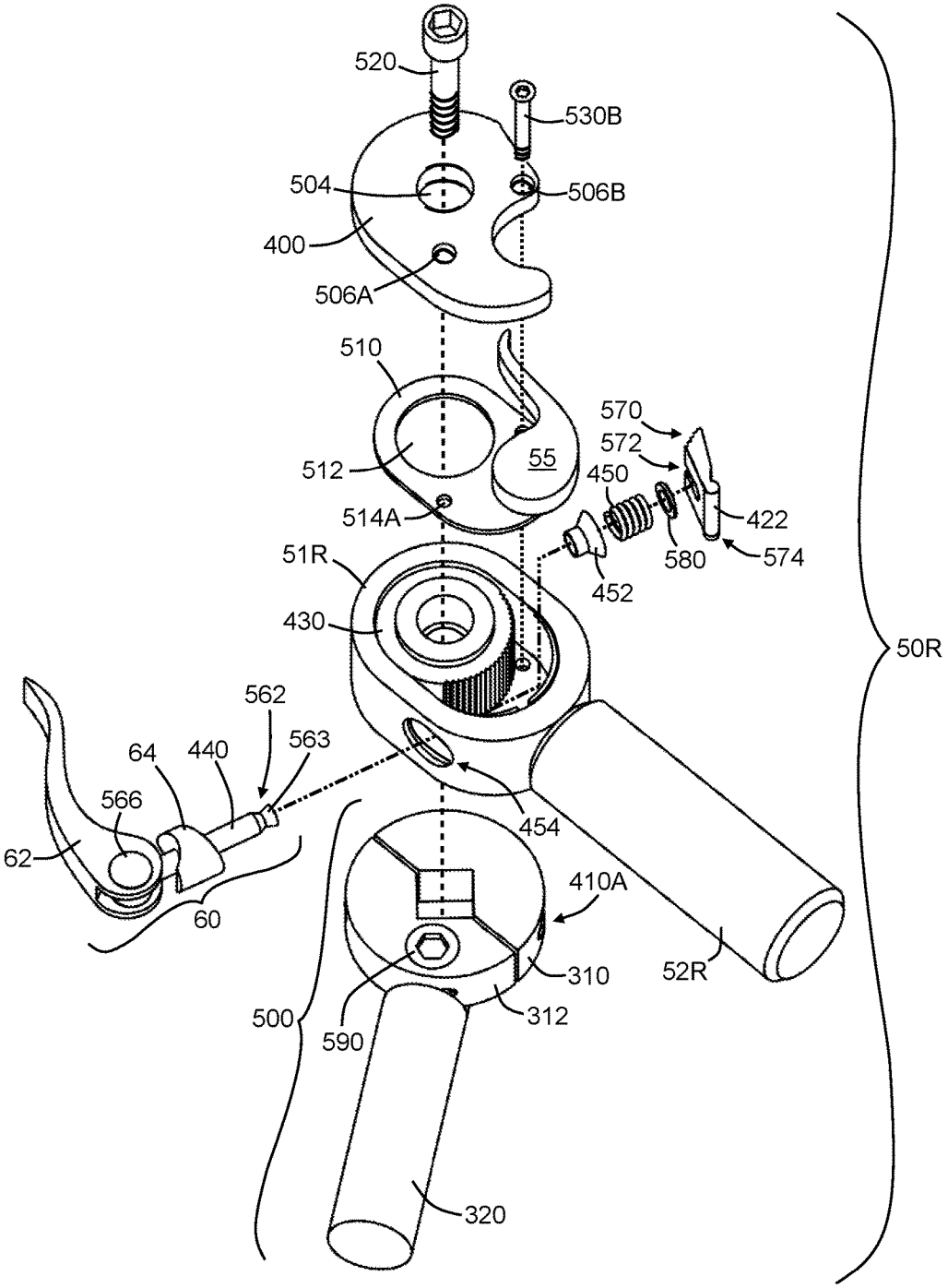
FIGS. 5A and 5B are exploded views of the right-side ratcheting pawl-type transitioning mechanism.
Figure 5B:
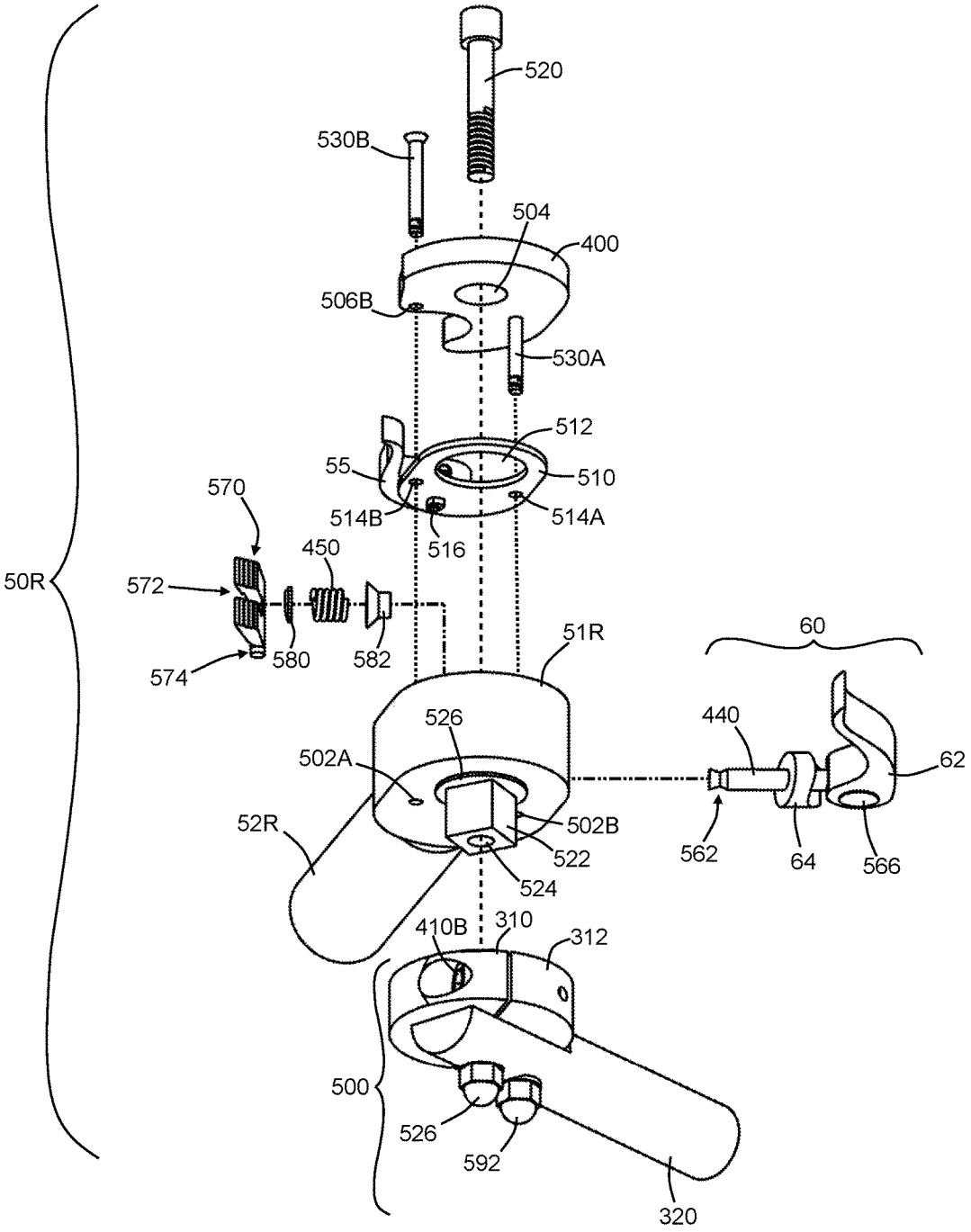

FIGS. 5A and 5B are exploded illustrations of the right-side load transitioning mechanism 50R. Connector shaft subassembly 500, which comprises connector shaft 320 fastened to lower torque clamp member 312 with flat-headed bolt 390 and dome nut 392 (visible in FIG. 5B only). Upper torque clamp member 310 is bolted to lower torque clamp member 312 using bolts 410A and 410B wherein the two serve to rigidly fasten the cylindrical connector shaft 320 to square portion 522 (visible in FIG. 5B only) of torque wheel 430. Hex cap bolt 520 projects centrally through torque wheel 430 and also through cylindrical connector shaft 320 and is tightened using dome nut 526 (visible in FIG. 5B only), effectively unifying cylindrical connector shaft 320 with torque wheel 430; these components form the portion of the joint which, in this embodiment, remains in a fixed orientation relative to the frame of the wheelchair.

The rotatable portion of the joint, on the other hand, is formed by casing 51R which is unified with male coupling member 52R, and also by inner faceplate 510 and outer faceplate 400, including components attached thereto. Inner faceplate 510 is fitted in place within recessed ridge 516 machined along the edge of the opening of casing 51R. Outer face plate 400 is drawn against inner faceplate 400 and casing 51R by flathead machine screws 506A and 506B projecting through holes 514A and 514B of inner faceplate 510 and into threaded holes 502A and 502B (visible in FIG. 5B only) of casing 51R. Integrated with inner faceplate 510 is elastomeric force sustainer cam 516 (visible in FIG. 5B only) which is rotationally secured with both biasing switch lever 55 disposed on the opposite side of inner faceplate 510.

Torque wheel 430 has a first lip 434 which projects snugly through aperture 512 of inner faceplate 510. Torque wheel 430 also has a second lip 526 which projects snugly through aperture 504 of casing 51R (visible in FIG. 5B only). Relative rotation occurring between the rotatable portion of the joint and the fixed portion thereof is thus accompanied by the first lip 434 and the second lip 526 rotating within the circular regions defined by the apertures through which they project. As loading on the joint is substantially borne at these contact regions, it may be preferable to fashion the torque wheel 430, the casing 51R, and the inner faceplate 510 using alloy steel or hardened steel, and it may be further preferable to apply lubricant at these contact regions during assembly.

Binding cam subassembly 60 is shown separated from the mechanism, and can be seen as having binding skewer 440 of substantially cylindrical shape, which projects through cam shaft 566 and cam spacer 64. At the end opposite that projecting through cam shaft 566 is a circumferential groove 562 which, while the mechanism is assembled, projects through pawl bearing 420 and fits within notch 572 of pawl bearing 420 in a manner which allows sufficient "rocking" action to occur therebetween so that pawl bearing 420 freely moves between its position of engagement with torque wheel 430 and its position of disengagement therewith. As binding skewer 440 is drawn by the camming action of the cam lever arm 62 as it is rotated about cam shaft 566, the distal end portion 563 of binding skewer 440 applies binding force to the pawl bearing, drawing it tightly and effectively locking the position of the rotatable portion of the joint relative to the fixed portion of the joint. As indicated in FIGS. 5A and 5B, binding skewer 440 also projects through aperture 454 of casing 51R, as well as through flanged washer 452, disengagement spring 450, and nylon washer 580.

Pawl bearing 420 is shown as comprising a plurality of teeth on contact region 570, dimensioned and spaced so as to enmesh perfectly with a plurality of teeth on toothed contact region 432 of torque wheel 430. In other embodiments, alternative tooth arrangements may be found to be suitable, such as having a pawl bearing comprising a singular tooth which nests into a singular groove of the torque wheel, although it has been found useful to employ a plurality of teeth in order to minimize the likelihood of slippage between the pawl bearing and the torque wheel while also achieving maximum "contrast" between the engagement and disengagement positions, especially given a relatively small amount of space for rotation of the pawl bearing.

Figure 6:
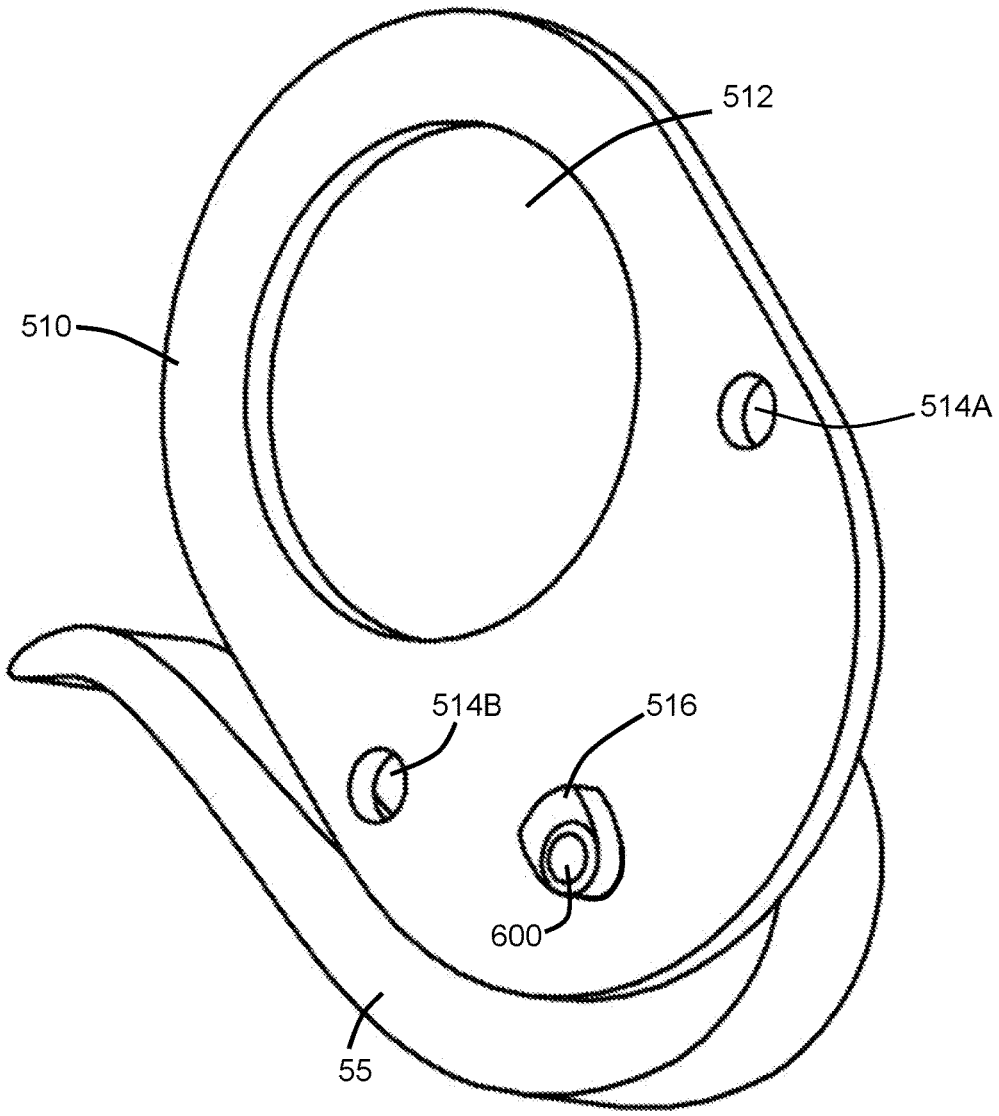

FIG. 6 shows, in greater detail, the structure of inner faceplate 510 as well as the integration of the elastomeric force sustainer cam 516 therewith. Projecting through an aperture (not visible) through inner faceplate 510 is shaft 600 which is threaded and bonded or otherwise rotationally secured with both biasing switch lever 55 and elastomeric force sustainer cam 516. Torque is transferred through shaft 600 to elastomeric force sustainer cam 516 as a result of manual force applied by the user against biasing switch lever 55 in a rearward (engaging) direction or a forward (disengaging) direction. The inner faceplate also serves to provide support for the torque wheel (shown in FIGS. 5A and 5B) as main aperture 512 maintains lip 434 of torque wheel 430 in a fixed location within the mechanism casing 51R (not shown), yet still permits relative rotation between the casing and the torque wheel 430 (not shown). Inner faceplate 510 is also shown having screw apertures 514A and 514B through which machine screws 402A and 402B (not shown) project.

Figure 7A:
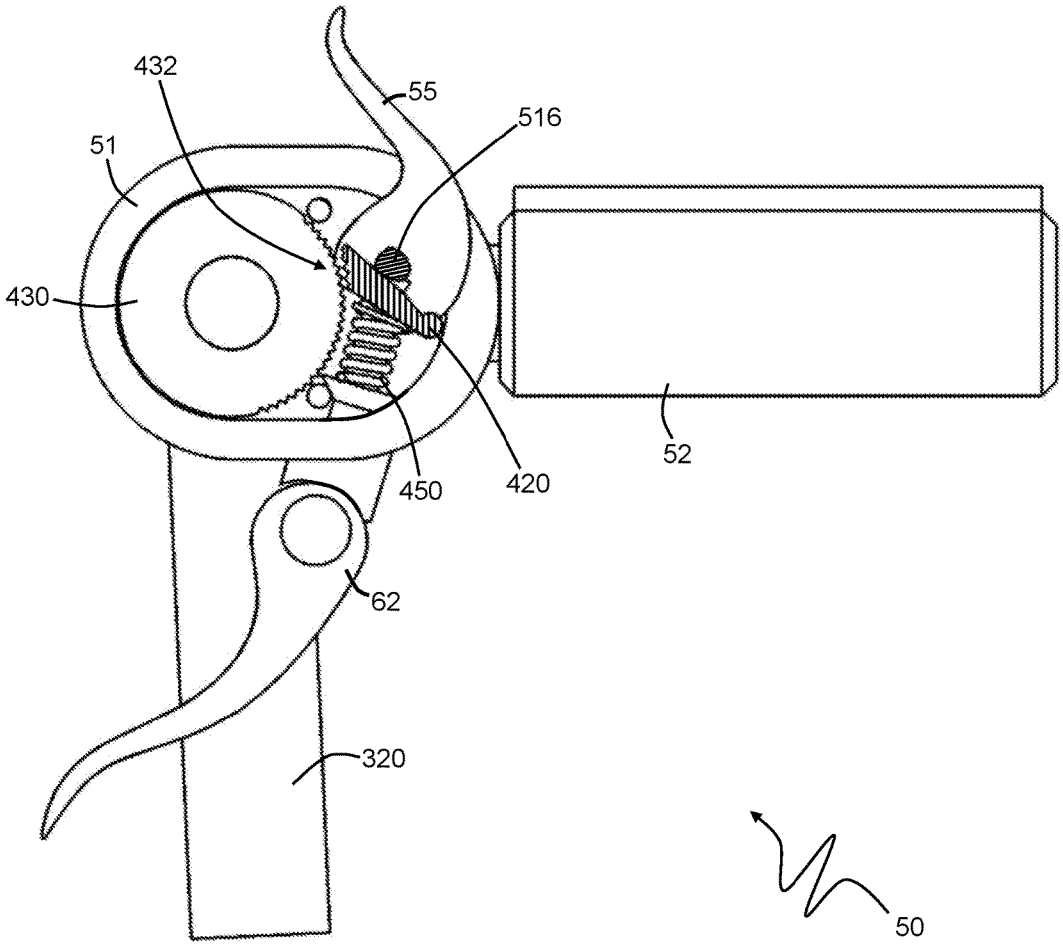
FIGS. 7A-7F illustrate the positioning of internal and external components of a ratcheting pawl-type transitioning mechanism during the cyclic operation sequence, including steps for alternating a binding cam lever between an unbound state and a bound state.

FIGS. 7A-7F illustrate the positioning of the internal and external components of the load-transitioning mechanism 50 as it is transitioned through the distinct stages of the operation sequence. In FIG. 7A, the load transitioning mechanism 50 is shown in the unbound, attach/release stage of operation, wherein disengagement spring 450 is relaxed both due to the positioning of the distal end portion 563 of the binding skewer 440 (not visible) and that of the elastomeric force sustainer cam 516, having binding cam lever arm 62 in its downward (unbound) position and having biasing switch lever 55 in its forward (disengaging) position. The rotatable joint portion of load transitioning mechanism 50, formed by casing 51 and male coupling member 52, is freely rotatable relative to the fixed joint portion (affixed relative to the wheelchair frame) formed by the cylindrical connector shaft 320 and torque wheel 430. Pawl bearing 420, in this stage, is maintained away from contact with toothed contact region 432 of torque wheel 430 as long as binding cam lever arm 62 and biasing switch lever 55 are kept in the positions shown in FIG. 7A.

Figure 7B:
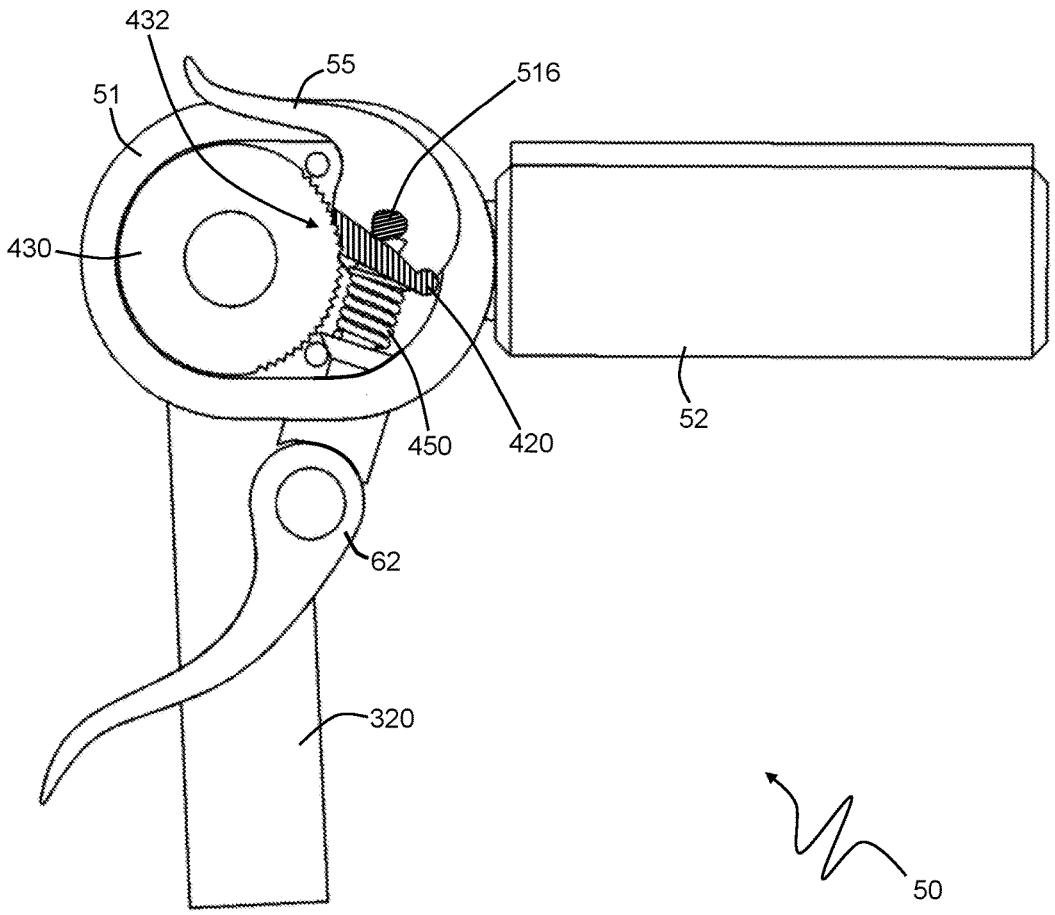

In FIG. 7B, the load transitioning mechanism 50 is shown in the unbound, pre-deployment stage of operation, wherein disengagement spring 450 is compressed due to the rotation of the elastomeric force sustainer cam 516 in an engaging direction, having biasing switch lever 55 in its rearward (engaging) position. The rotatable joint portion of load transitioning mechanism 50 (formed by casing 51 and male coupling member 52) is rotatable in the clockwise direction relative to the fixed joint portion (formed by the cylindrical connector shaft 320 and torque wheel 430), but is prevented from rotating in the counterclockwise direction due to engagement of the pawl bearing 420 with toothed contact region 432 of torque wheel 430. During each incremental clockwise advancement of the rotatable joint portion as the user performs the wheel-stand maneuver, pawl bearing 420 is rotated away from the torque wheel 430 as the teeth of pawl bearing 420 are urged out of their nested contact between the teeth of the torque wheel 430 to slide over the teeth of the torque wheel 430 and come into nested contact between the next set of teeth; rotation of pawl bearing 420 is permitted due to compression of elastomeric force sustainer cam 51.

Figure 7C:
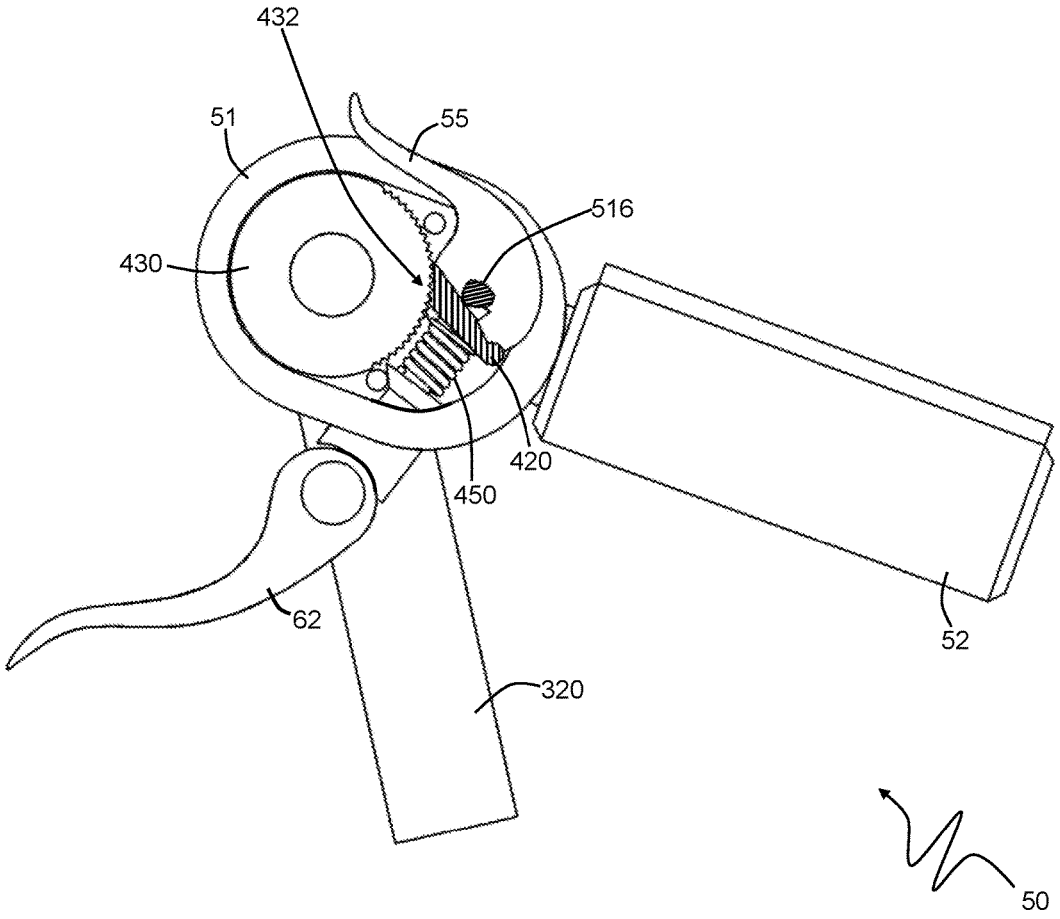

The unbound, deployment stage, shown in FIG. 7C, is reached upon achieving full downward (clockwise) rotation of the rotatable joint portion as a result of the user performing the wheel-stand maneuver. In this stage, disengagement spring 450 remains compressed due to rotation of the elastomeric force sustainer cam 516 in the engaging direction, as well as due to frictional forces now acting between the toothed contact regions of the pawl bearing 420 and the torque wheel 430. The rotatable joint portion of load transitioning mechanism 50 (formed by casing 51 and male coupling member 52), is rotationally fixed relative to the fixed joint portion (formed by the cylindrical connector shaft 320 and torque wheel 430).

Figure 7D:
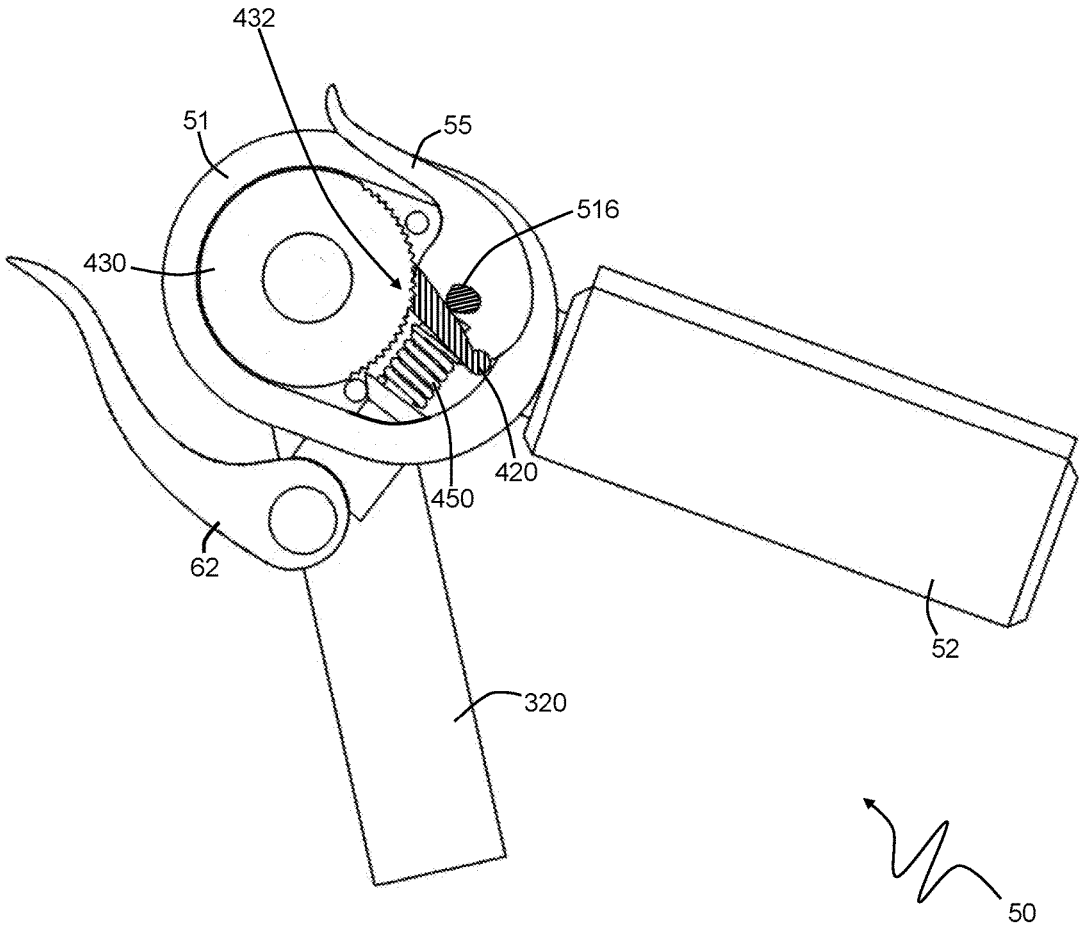

The bound, deployment stage, shown in FIG. 7D, is achieved by the user pulling lever arm 62 of binding cam subassembly 60 in the upward direction to draw binding skewer 440 in the downward direction to effectively bind pawl bearing 420 in its position of engagement with torque wheel 430, thereby preventing any relative rotation to occur between the rotatable joint portion and the fixed joint portion of the load transitioning mechanism 50. Furthermore, in this stage, accidental movement of biasing switch lever 55 by the user will not cause disengagement of pawl bearing 420 from torque wheel 430 due to the rigid locking effect conferred by the binding action of the binding cam subassembly 60.

Figure 7E:
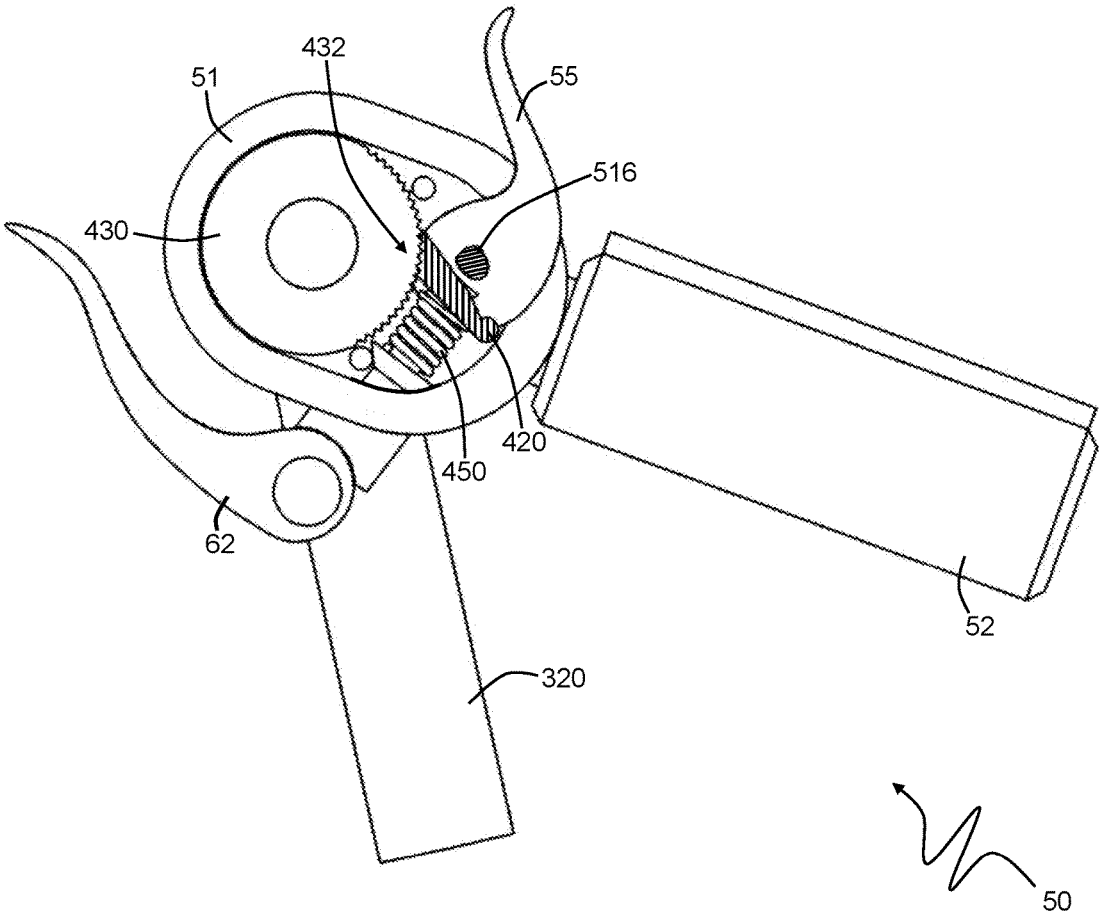

FIG. 7E shows the load transitioning mechanism 50 in the bound, pre-release stage, wherein the user has rotated biasing switch lever 55 to its forward (disengaging) position, thereby orienting elastomeric force sustainer cam 516 so that it no longer contacts pawl bearing 420 and a gap of at least about 1 millimeter is created therebetween. Nevertheless, pawl bearing 420 remains bound against torque wheel 430 due to lever arm 62 of binding cam subassembly 60 being maintained in the upward direction so that binding skewer 440 is maintained in the downward direction. The bound, pre-deployment stage can thus be considered to be a safety measure, wherein the user must manipulate both the biasing switch lever 55 and the binding cam lever arm 62 in order to prepare the mechanism for transition back to the unbound, attach/release stage; the user intentionality required for effectuating this transition is a crucial aspect of the overall safety of using a device according to the present disclosure.

Figure 7F:
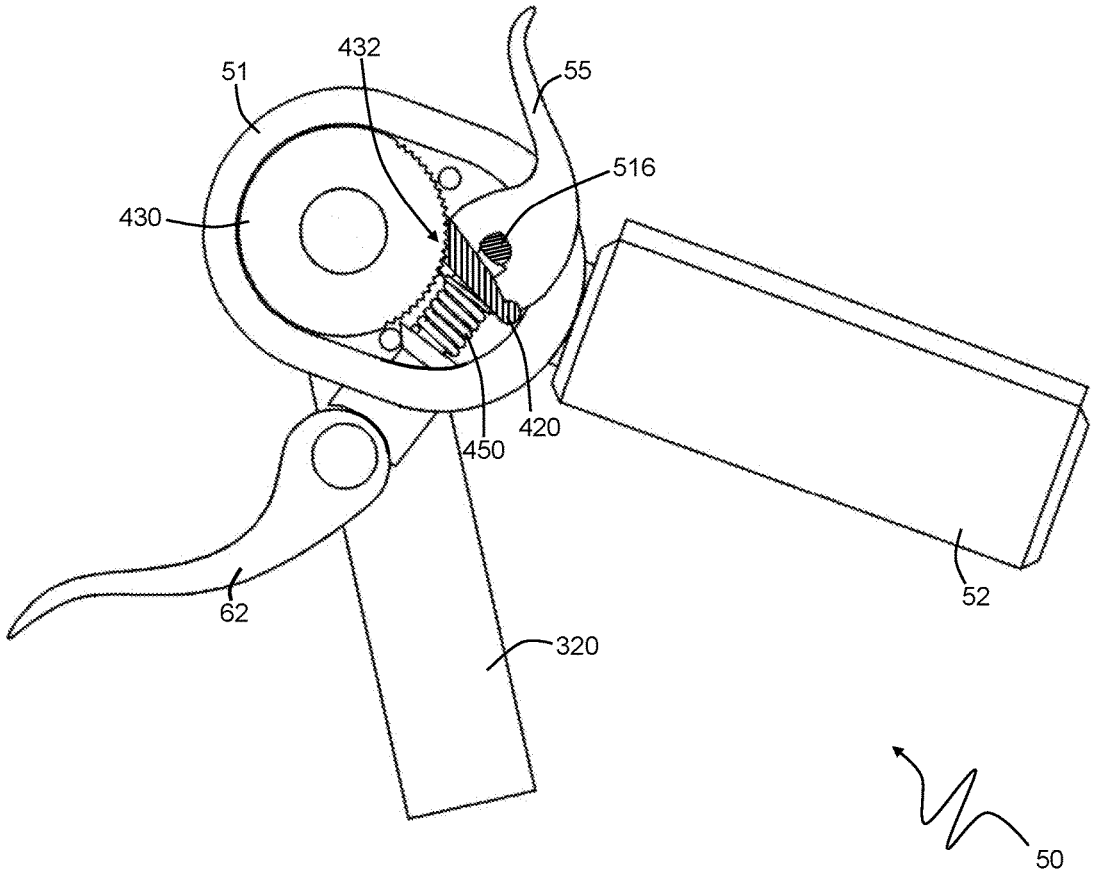

The unbound, pre-release stage, shown in FIG. 7F, is achieved by the user pushing lever arm 62 of binding cam subassembly 60 in the downward direction to permit movement of binding skewer 440 in the upward direction, as a result of sustained urging force applied in the upward direction against pawl bearing 420 by disengagement spring 450. Pawl bearing 420 is, at this stage, prepared to move out of its position of engagement with torque wheel 430, such that a slight recline action of the wheelchair subsequently performed by the user will relieve the frictional forces acting between the toothed regions of pawl bearing 420 and torque wheel 430 and will thereby allow disengagement spring 450 to assume a relaxed, decompressed form as it forces pawl bearing 420 away from torque wheel 430.

Figure 8A:
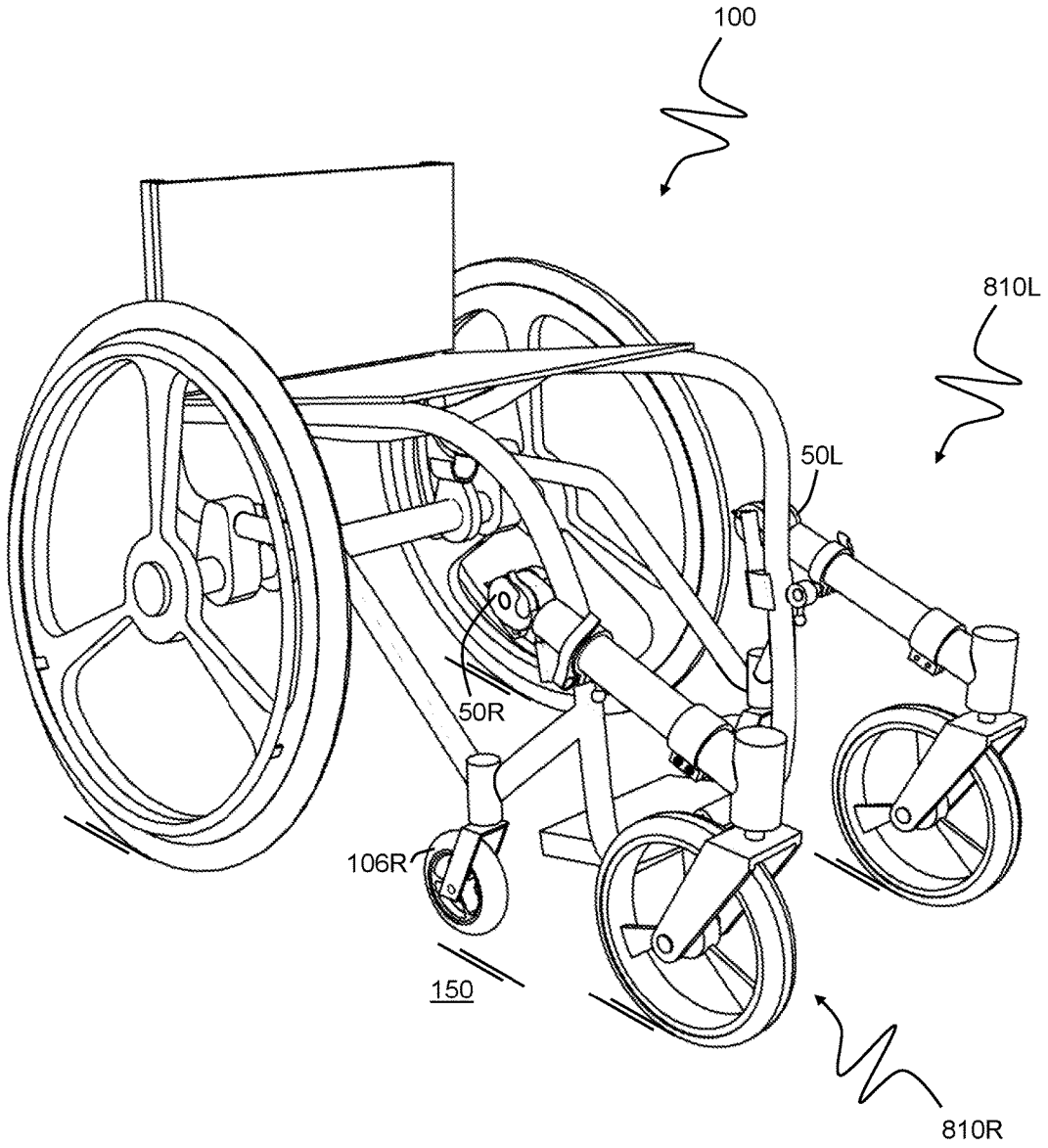
FIGS. 8A-D show several useful applications of load transitioning mechanisms in conjunction with ground-contacting implements.

FIG. 8A shows the wheelchair 100 outfitted with dual, left and right adaptive caster wheel implements 810L and 810R, with the wheelchair 100 in the modified load-bearing configuration wherein the primary caster wheels 106L (not visible) and 106R are elevated from contact with the ground surface 150.

Figure 8B:
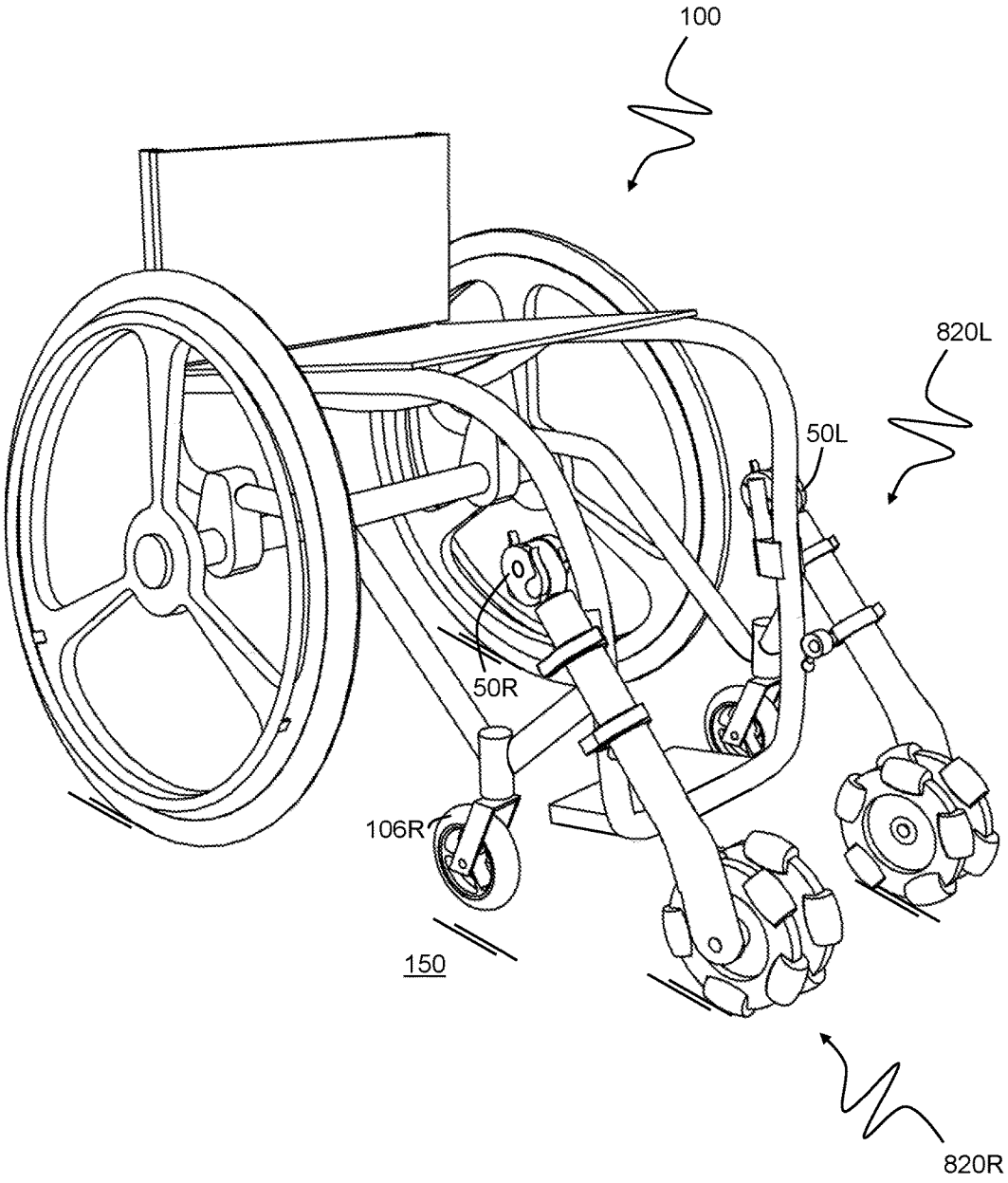

In FIG. 8B, the wheelchair 100 is outfitted with dual, left and right omniwheel implements 820L and 820R which enable movement of the wheelchair in all directions by virtue of a plurality of rollers disposed concentrically around the axis of rotation of the wheels. The primary caster wheels 106L and 106R are elevated from contact with the ground surface 150.

Figure 8C:
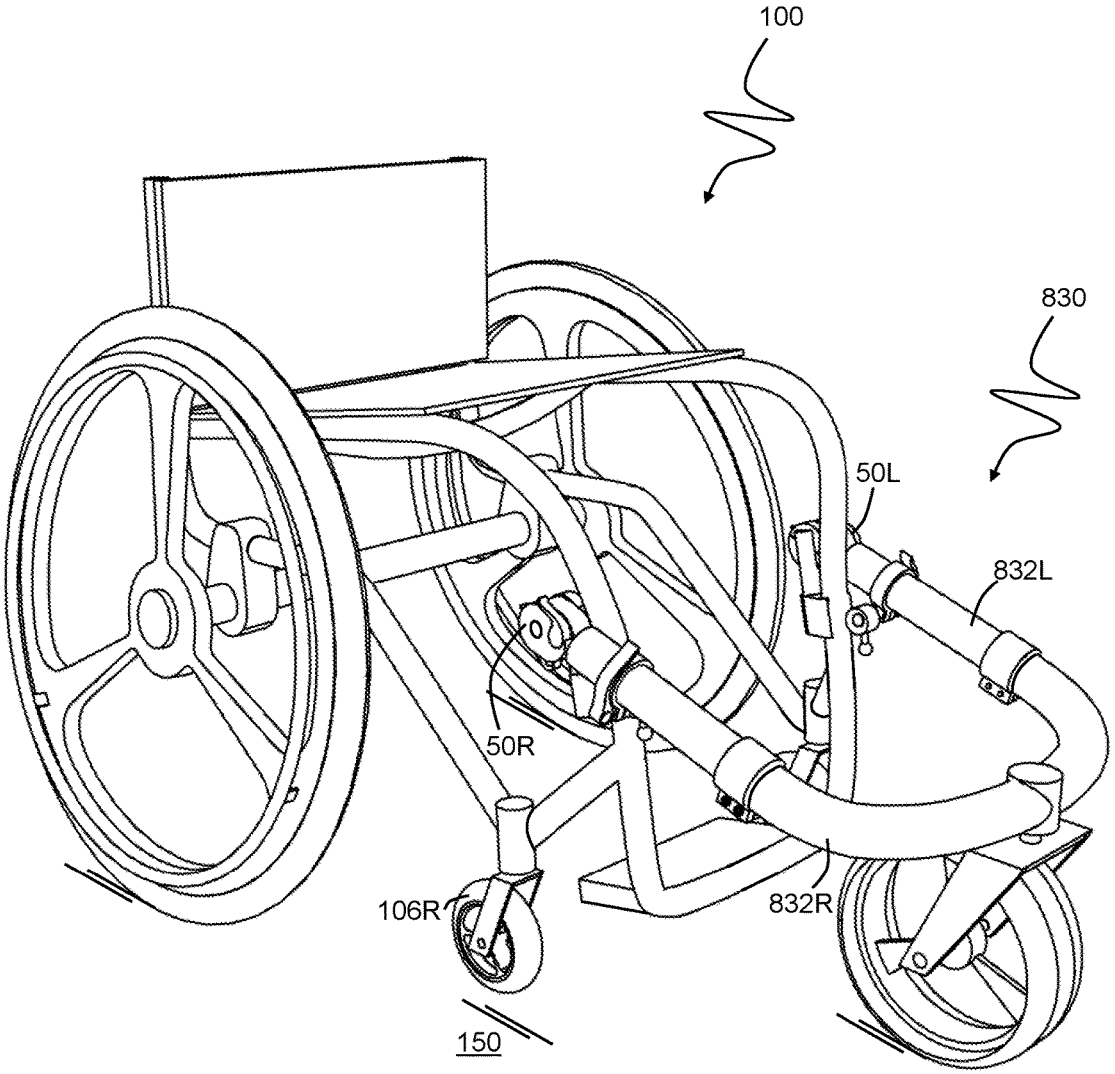

In FIG. 8C, the wheelchair 100 is outfitted with a single, symmetrically-disposed adaptive caster wheel apparatus 830 having dual, left and right support arms 832L and 832R which couple with left and right transitioning mechanism assemblies 50L and 50R. The primary caster wheels 106L and 106R are elevated from contact with the ground surface 150.

Figure 8D:
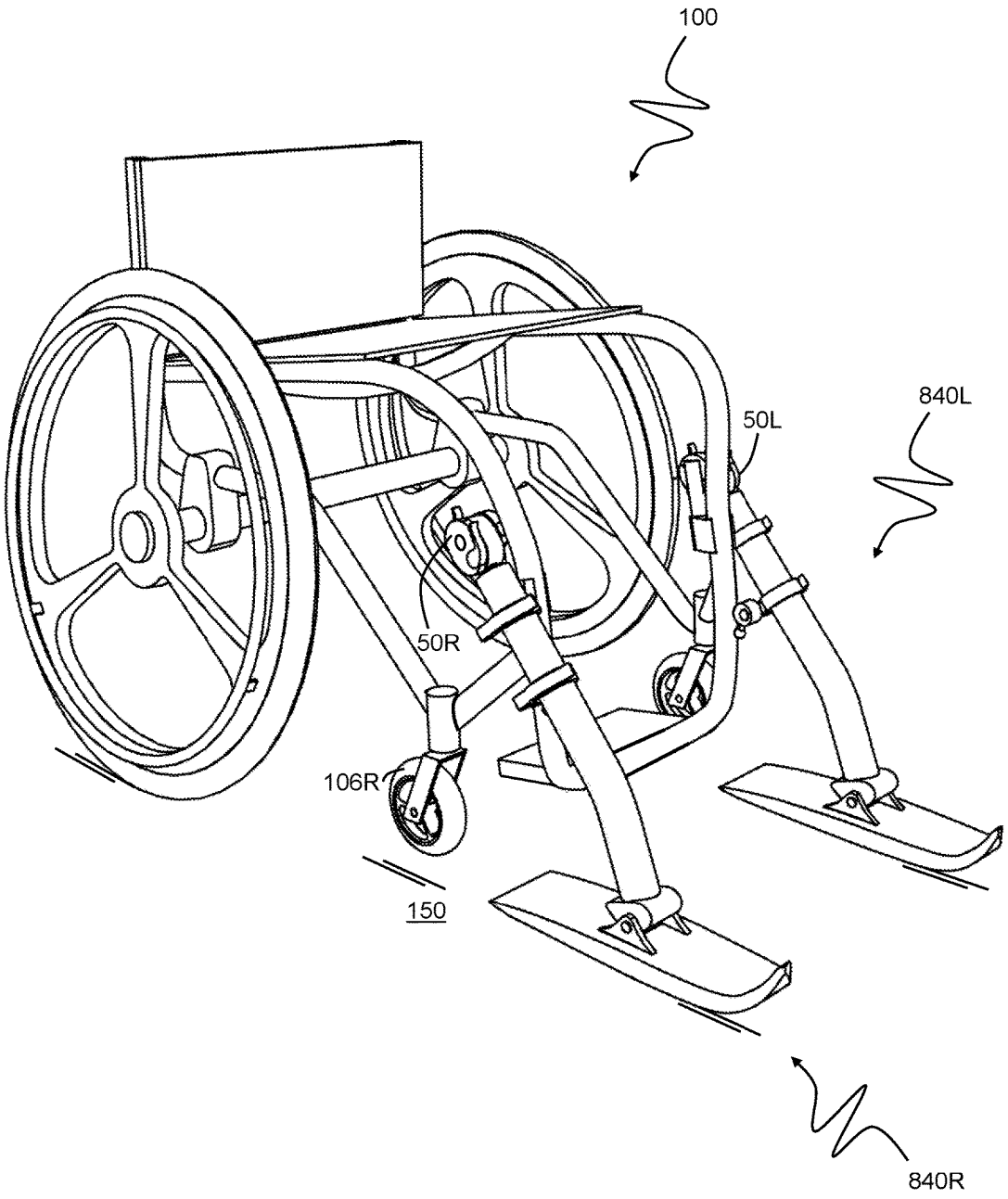

In FIG. 8D, the wheelchair 100 is outfitted with dual, left and right ski implements 840L and 840R which enable movement of the wheelchair over snow, ice or sand. The primary caster wheels 106L and 106R are elevated from contact with the ground surface 150.

Figure 9:
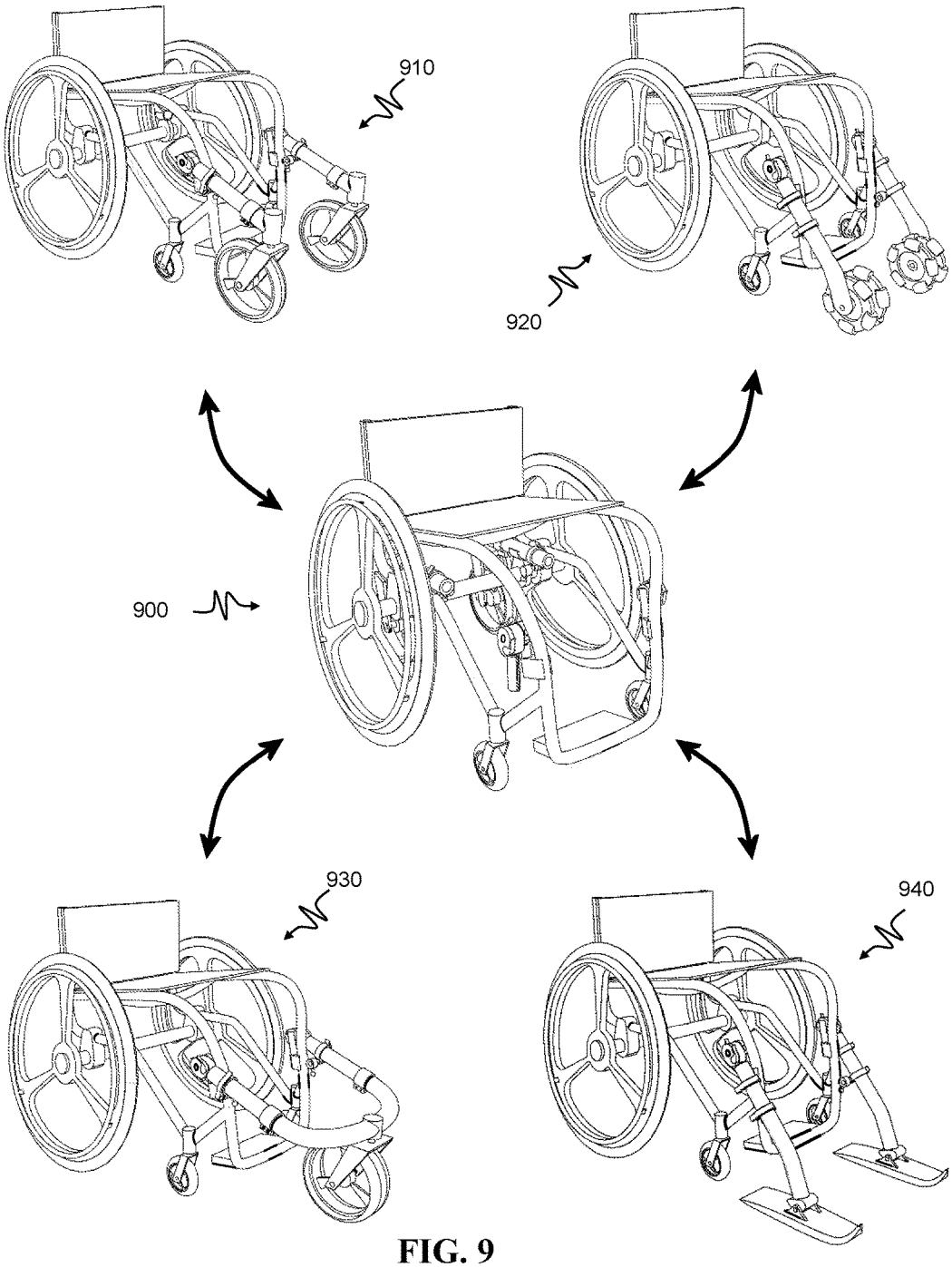
FIG. 9 is a diagram summarizing the reconfiguration capabilities enabled by the load transitioning mechanism.

FIG. 9 summarizes the reconfiguration capabilities enabled by the load transitioning mechanism, wherein a reconfigurable wheelchair 900 is capable of being outfitted with a variety of ground-contacting adaptive implements which confer special functionalities and an extended wheelbase. A user is thus enabled to reconfigure the wheelchair among a dual caster wheel mode 910, a dual omniwheel mode 920, a single caster wheel mode 930, and a dual ski mode 940.

EXAMPLE I

An early prototype was devised having a single integrated 8-inch caster wheel assembly, a load-transitioning mechanism, and a releasable clamp assembly. The prototype was built and configured for the purpose of lengthening the effective wheelbase of an "everyday" wheelchair and also for decreasing the rolling resistance experienced by the user, especially while traversing over ground substrates such as sand, gravel, woodchips, grass, and snow.

The apparatus was configured to be removably and adjustably affixed to the tubular frame of both an Invacare Top End Terminator Titanium wheelchair and a Ti-Lite TRA rigid-style ultralight titanium wheelchair, by way of a hinged clamp adapted to be quickly and securely affixed onto the left forward lateral support of the tubular frame of the wheelchair, both wheelchairs having a frame made of 1-inch diameter titanium tubing; the device occupies a space immediately above the left-side primary caster wheel assembly of the wheelchair. The load transitioning mechanism, clamp assembly, and caster wheel assembly may thus be removed from one wheelchair and attached to the other if so desired. An ABS plastic tube clip mounted atop the rear axle of the Ti-Lite TRA wheelchair serves as a useful means for stowing the apparatus beneath the seat of the wheelchair while not in use.

The mechanism was constructed to be capable of withstanding torque in excess of 300 ft-lbs. The rotatable portion of the mechanism assembly was fitted with a tubular extension arm which connects to the caster wheel assembly, and the fixed portion of the mechanism assembly was secured to the aluminum clamp assembly using an M6 diameter hardened bolt and a ¼-20 stainless machine screw.

Internally, the mechanism has a single, toothed pawl which incrementally engages with a toothed torque wheel at every 5 degree of rotation in a first direction for load-bearing purposes, whereas the toothed pawl does not load-bearingly engage with the torque wheel in the opposing direction of rotation and permits free rotation thereof in said opposing direction. The toothed pawl is seated within its own recess which has been bored into the steel casing surrounding the mechanism, the toothed pawl being capable of rotating about its own axis of rotation projecting centrally through the bored recess (bearing seat) and parallel to the major axis of rotation of the mechanism itself.

A solid elastomeric force sustainment element, composed of cast polyamide (nylon) plastic having a modulus of elasticity of about 2.8 GPa ($0.4\times10^6$ psi), was fabricated to have a cylindrical shaft which fits tightly and rotates within a circular hole drilled through a cover plate of the casing. On a first end of the cylindrical shaft, projecting into the casing and contacting a side region of the toothed pawl, is an eccentric oval-shaped cam portion, also composed of nylon plastic. The opposing end of the cylindrical shaft, projecting to the exterior of the casing, is affixed to a manipulable lever.

The cam rotates in a direction corresponding to rotation of the lever about an axis passing centrally through the cylindrical shaft of the force sustainment element, selectively applying or removing urging force maintained against the pawl by the nylon cam portion, thus enabling the user to repeatably toggle the mechanism between an engaging state and a disengaging state by manipulably imparting rotation to the cam portion, via the lever, between two opposing positions.

Due to the snug fit of the cylindrical shaft within the circular hole of the cover plate as well as the eccentric placement of the cam relative to the axis of the cylindrical shaft, the manipulable lever holds its engaging and disengaging positions without being forced out of position, thus serving as a reliable "control switch" to control the internal state of the mechanism. The holding power of the control switch, as just described, furthermore overcomes an opposing spring pressure applied against the toothed pawl by a disengaging compression spring disposed internally.

The elasticity of the solid elastomeric force sustainment element is critical to the capacity for the mechanism to successfully transition through the cyclic operation sequence. After clamping the apparatus to the wheelchair and rotating the manipulable lever to toggle the mechanism to the engaging state, that is, with the mechanism is in the pre-deployment stage, the cam portion of the solid elastomeric force sustainment element maintains pressure against the toothed pawl to force the teeth of the pawl to be seated into the grooves between the teeth of the torque wheel. As the user reclines the wheelchair to impart rotation of the movable portion of the apparatus relative to the fixed portion, the cam portion compresses sufficiently to permit a slight amount of rotation of the pawl necessary for the teeth of the torque wheel to advance to the next incremental position of rotation relative to the teeth of the pawl.

With the apparatus clamped to the wheelchair frame, upon the user reclining the wheelchair, relative rotation between the clamp assembly (the fixed portion) and the caster wheel assembly (the movable portion) causes the torque wheel to rotate relative to the toothed pawl as far as the external rotation-limiting detent will allow. Subsequently, upon the user resting his or her weight towards the forward end of the wheelchair, the toothed pawl becomes fully engaged with the torque wheel so that relative rotation in the first direction is inhibited and the forward portion of the wheelchair load is supported as a result of the load being transferred from the torque wheel, through the toothed pawl, to the bored recess in which the toothed pawl is seated. The user may further secure the joint by actuating a releasable cam-lever tensioner having a steel rod which projects through the casing and which is adapted to draw the toothed pawl tightly against the torque wheel, thereby eliminating any play or wiggle that would otherwise tend to occur during use of the apparatus while the wheelchair user traverses irregular terrain.

To convert the wheelchair from its original configuration to the adapted configuration, the user first clamps the apparatus to a forward region of the frame of the wheelchair. The forward region may be specially adapted for receiving the clamp, such as with a pair of semi-circular adapting shims, to establish a compatible outer diameter of the forward region to which the clamp may be secured.

Next, the user manually actuates the manipulable lever in an engaging direction by pushing the lever rearward, and he subsequently lowers the apparatus until the caster wheel contacts the ground surface. The user effectuates the transition to the adapted configuration by reclining the wheelchair backward to cause a rotation-limiting projection integrated with the rotatable portion of the apparatus to contact a portion of the clamp (affixed to the frame of the wheelchair) so that the primary caster wheels of the wheelchair are elevated and maintained at a predetermined distance of approximately 1½ inches above the ground surface. The user then further secures joint of the mechanism by tightening a cam-action tensioning assembly, which draws the toothed pawl tightly against the torque wheel. The caster wheels of the wheelchair remain elevated above the ground surface during travel in all directions and do not add rolling resistance or otherwise interfere with the performance of the wheelchair in its adapted mode, as the large forward caster wheel now bears the load distributed towards the front of the wheelchair.

To remove the attachable caster wheel implement from the wheelchair—that is, to convert the wheelchair from the adapted configuration back to the original configuration—the user first loosens the cam-action tensioning assembly of the mechanism to release its pulling force upon the toothed pawl. The user then manually actuates the control switch of the mechanism in a disengaging direction by pushing the lever forward to fully release engaging pressure placed upon the toothed pawl; at this time the apparatus will continue to bear the load distributed toward the front of the wheelchair, due to high frictional forces maintained between the toothed pawl and the torque wheel as a result of the forward weight supported by the apparatus. Upon the user reclining the wheelchair backward so that the primary caster wheels of the wheelchair are elevated slightly, the frictional forces between the toothed pawl and the torque wheel are relieved and the internal disengagement spring forces the toothed pawl away from contact with torque wheel so that, as the user subsequently brings the wheelchair into its upright, unreclined position, the primary caster wheels of the wheelchair are instantly lowered down into contact with the ground surface; thus the user effectuates the transition back to the original load-bearing configuration. The user is then able to lift the caster wheel implement upward and unclamp and detach the caster wheel implement from the frame of the wheelchair.

The user, having a complete spinal cord injury at the level of the sixth thoracic vertebra, has no motor or sensory function in his legs and in the lower half of his torso, and has benefited from the smoother riding characteristics and the added forward stability that result from attachment of the apparatus to his wheelchair. With the adaptive caster wheel deployed, the user has avoided being forwardly tumbled or ejected from the seated position and has furthermore been able to allocate more time towards enjoying and viewing the surrounding landscape while propelling the wheelchair forward, such as around his neighborhood and at a nearby state park, with less time directed towards observing and avoiding the small bumps, cracks, tree roots, and other obstacles that would otherwise put him at significant risk of falling out of his wheelchair.

EXAMPLE II

Dual (left and right) adaptive caster wheel apparatuses, each having a load-transitioning mechanism which separably integrates with a ground-contacting adaptive caster wheel implement, were built and configured for the purpose of lengthening the effective wheelbase of the wheelchair and also for decreasing the rolling resistance experienced by the user, especially while traversing over ground substrates such as sand, gravel, woodchips, grass, and snow.

Both apparatuses were configured to be removably and adjustably affixed to the tubular frame of a Ti-Lite TRA rigid-style ultralight titanium wheelchair by way of mounting clamps used to semi-permanently affix symmetrically opposing load transitioning mechanism assemblies onto the left and right forward lateral supports of the tubular frame of the wheelchair; each mechanism assembly occupies a space immediately above a primary caster wheel assembly on its respective side of the wheelchair. Both load transitioning mechanism assemblies remains affixed to the wheelchair at all times and are unobtrusive to the user's arms, legs, and feet, and outerwear, including while any adaptive implements are decoupled from the load transitioning mechanism assemblies.

Both apparatuses were further configured to receive any one of a variety of adaptive implements, most notably a selection of attachable all-terrain caster wheel implements adapted for use in urban, suburban, and rural environments encountered in the State of Wisconsin.

To convert the wheelchair from its original configuration to the adapted configuration, the user first couples an attachable caster wheel implement (or other suitable ground-contacting adaptive implement) to its respective load transitioning mechanism assembly by sliding a receiver end of the implement over a male coupling member of the load transitioning mechanism assembly.

Next, the user manually actuates the manipulable lever of the biasing switch in an engaging direction by pushing the lever rearward, and subsequently lowering each caster wheel implement to a stable ground surface. The user effectuates the transition to the adapted configuration by reclining the wheelchair backward to cause a rotation-limiting projection disposed on an extension arm of each caster wheel implement to contact a portion of the wheelchair frame so that the primary caster wheels of the wheelchair are elevated and maintained at a predetermined distance of approximately ½- to 1-inch above the ground surface. The user then further secures joint of the mechanism by tightening a cam-action tensioning assembly integrated with the rotation-limiting projection, which creates additional compression between the caster wheel implement and the wheelchair frame, thereby reducing any wiggle or play therebetween.

For even greater security, the user may tighten an internal cam-action tensioning mechanism integrated with the load transitioning mechanism itself, which draws the toothed pawl tightly against the torque wheel.

Thus, the actions of tightening the external cam-action tensioning assembly (integrated with the rotation-limiting projection) and tightening the internal cam-action tensioning mechanism rigidly unifies each caster wheel implement with the frame of the wheelchair and ensures that their predetermined deployed positions are maintained without wiggle or play occurring during traversal over rough or irregular terrain. The caster wheels of the wheelchair remain elevated above the ground surface during travel in all directions and do not add rolling resistance or otherwise interfere with the performance of the wheelchair in its adapted mode, as the larger caster wheels now bear the load distributed towards the front of the wheelchair.

To remove the attachable caster wheel implements from the wheelchair—that is, to convert the wheelchair from the adapted configuration back to the original configuration—the user first loosens the internal cam-action tensioning mechanism to release its pulling force upon the toothed pawl. The user must also loosen the external cam-action tensioning assembly by rotating the cam away from contact with the frame of the wheelchair. The user then manually actuates the control switch of the mechanism in a forward (disengaging) direction by pushing the lever forward to fully release engaging pressure placed upon the toothed pawl; at this time each apparatus will continue to bear the load distributed toward the front of the wheelchair, due to high frictional forces maintained between the toothed pawl and the torque wheel as a result of the forward weight supported by the apparatus. Upon the user reclining the wheelchair backward so that the primary caster wheels of the wheelchair are elevated slightly, the frictional forces between the toothed pawl and the torque wheel of each mechanism are relieved and the internal disengagement spring forces the toothed pawl away from contact with torque wheel so that, as the user subsequently brings the wheelchair into its upright, unreclined position, the primary caster wheels of the wheelchair are instantly lowered down into contact with the ground surface; thus the user effectuates the transition back to the original load-bearing configuration. The user is then able to lift the caster wheel implements upward and decouple them from the load transitioning mechanism assemblies.

Having the load transitioning mechanism assemblies affixed to the wheelchair and ready to receive the attachable caster wheel implements, the user has benefited from improved versatility. As needed, the user quickly outfits the wheelchair with dual caster assemblies that are substantially larger and more robust than the original primary caster assemblies that are permanently integrated with the wheelchair. 75 mm wide, 8-inch diameter pneumatic tires fitted over aluminum wheel hubs were chosen because, when inflated, they exhibit excellent rolling resistance on both rugged surfaces and smooth surfaces alike, and provide sufficient grip against paved surfaces to help prevent flutter of the caster assemblies when approaching vehicle speeds of around 8 MPH or 12 KmPH, which is about average human running speed. Other wheel arrangements have been used, including 35 mm wide, 6-inch diameter soft-roll solid casters having aluminum hubs and connected to shock-absorbing suspension caster assemblies.

REMARKS

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above compositions, products, and methods without departing from the scope of aspects of the invention, it is intended that all matter contained in the above description shall be interpreted as illustrative and not in a limiting sense. Reference to particular illustrative embodiments should not be construed as limitations. The inventive devices, products, and methods can be adapted for other uses or provided in other forms not explicitly listed above, and can be modified in numerous ways within the spirit of the present disclosure. Thus, the present invention is not limited to the disclosed embodiments.

I claim:

1. A load transitioning mechanism for alternating a wheelchair between an original load-bearing configuration and a modified load-bearing configuration upon toggling of a biasing switch and rearward shifting of a load carried by the wheelchair, the wheelchair comprising a frame having a front portion, the wheelchair further comprising a pair of symmetrically-opposing rear wheels and a pair of symmetrically-opposing front caster wheels, the load transitioning mechanism comprising a rotary clutch having a joint axis, the rotary clutch comprising a bearing surface and a movable bearing, the bearing surface unified with a first one of a fixed joint body or a rotatable joint body, the movable bearing pivotably articulating with a second one of the fixed joint body or the rotatable joint body, the load transitioning mechanism adapted for selectable biasing of the movable bearing toward and away from a position of torque transmission between the fixed joint body and the rotatable joint body about the joint axis, the fixed joint body adapted to be immovably affixed to the front portion of the frame of the wheelchair, the movable bearing adapted for movement in an engaging direction to engage with the bearing surface and to establish torque transmission between the fixed joint body and the rotatable joint body about the joint axis of the rotary clutch, the movable bearing further adapted for movement in a disengaging direction to disengage from the bearing surface and to remove torque transmission between the fixed joint body and the rotatable joint body, wherein, while the wheelchair is in the original load-bearing configuration, a forward portion of a load carried by the wheelchair is supported by the pair of symmetrically-opposing front caster wheels and, while the wheelchair is in the modified load-bearing configuration, the forward portion of the load carried by the wheelchair is substantially supported by a ground-contacting implement affixed to the rotatable joint body.

2. The load transitioning mechanism of claim 1, the biasing switch adapted to enable alternation of the load transitioning mechanism between: 1.) a first biasing state, wherein the movable bearing is biased towards movement into a position of load-bearing torque transmission, and 2.) a second biasing state wherein the movable bearing is biased towards movement out of the position of load-bearing torque transmission wherein a net sustaining force applied against the movable bearing urges the movable bearing either into or out of the position of load-bearing torque transmission.

3. The load transitioning mechanism of claim 2, wherein, while the wheelchair is in the modified load-bearing configuration, upon manipulation of the biasing switch, frictional forces maintain the movable bearing in the position of load-bearing torque transmission until the ground-contacting implement is momentarily relieved from supporting the forward portion of the load carried by the wheelchair to engender relative rotation between the rotatable joint body and the fixed joint body to substantially release the movable bearing from the frictional forces acting between the movable bearing and the bearing surface to enable movement of the movable bearing and to effectuate alternation of the load transitioning mechanism between the first biasing state and the second biasing state.

4. The load transitioning mechanism of claim 2, wherein while the wheelchair is in the original load-bearing configuration with the load transitioning mechanism operatively interposed between the ground-contacting implement and the frame of the wheelchair, manipulation of the biasing switch to place load transitioning mechanism in the first biasing state, followed by rearward reclining of the wheelchair results in:

Downward rotation of the ground-contacting implement about the joint axis;

A position shifting of the symmetrically-opposing front caster wheels to between about one-half inch and about three inches above a ground surface;

Load-bearing contact of the ground-contacting implement with the ground surface;

Transmission of torque between the fixed joint body and the rotatable joint body about the joint axis by the movable bearing; and Sharing of the load carried by the wheelchair among the pair of symmetrically-opposing rear wheels and the ground-contacting implement, with the wheelchair maintained in a reclined position;

and wherein, while the ground-contacting implement is engaged with the ground surface and sharing the load carried by the wheelchair with the pair of symmetrically-opposing rear wheels, manipulation of the biasing switch to place the load transitioning mechanism in the second biasing state followed by rearward shifting of the load carried by the wheelchair and subsequent return of the wheelchair to an upright position results in:

Upward rotation of the ground-contacting implement about the joint axis;

Release from load-bearing contact of the ground-contacting implement from the ground surface;

Reengagement of the symmetrically-opposing front caster wheels with the ground surface;

Removal of torque transmission between the fixed joint body and the rotatable joint body about the joint axis by the movable bearing; and Sharing of the load carried by the wheelchair among the pair of symmetrically-opposing rear wheels and the symmetrically-opposing front caster wheels, with the wheelchair maintained in an upright, unreclined position.

5. The load transitioning mechanism of claim 1, said movable bearing comprising at least one tooth adapted for engagement with at least one groove disposed on the bearing surface.

6. The load transitioning mechanism of claim 1, adapted for attachment and deployment of a caster wheel assembly, said caster wheel assembly comprising a wheel having a substantially greater diameter than either of the symmetrically-opposing front caster wheels of the wheelchair, the wheel of the caster wheel assembly having a rotation axis, said caster wheel assembly further comprising a pivotable portion having a vertical pivot axis, wherein, while the wheelchair is in the modified load-bearing configuration, the wheel of the caster wheel assembly rotates about the rotation axis in concert with movements of the wheelchair, and the pivotable portion of the caster wheel assembly pivots about the vertical pivot axis in response to changes in a direction of the wheelchair.

7. The load transitioning mechanism of claim 1, further comprising a spring adapted for imparting a sustaining force to the movable bearing to enable movement of the movable bearing in the disengaging direction.

8. The load transitioning mechanism of claim 1, further including a rotation-limiting detent to restrict downward rotation of the ground-contacting implement affixed to the rotatable joint body, wherein transitioning of the wheelchair to the modified load-bearing configuration results in the ground-contacting implement assuming a predetermined angular orientation relative to the frame of the wheelchair.

9. The load transitioning mechanism of claim 1, further including a skewer capable of applying force directly against the movable bearing to draw the movable bearing against the bearing surface.

10. An alternatable reconfiguration apparatus for a wheelchair for enabling attachment, positioning, and detachment of an adaptive implement by a user of the wheelchair, said alternatable reconfiguration apparatus capable of alternating the wheelchair between an original load-bearing configuration and a modified load-bearing configuration as a result of toggling of a control switch followed by rearward shifting of a load carried by the wheelchair, the wheelchair comprising a frame having a front portion, the wheelchair further comprising a pair of symmetrically-opposing rear wheels interconnected by a rear axle, the wheelchair further comprising a pair of symmetrically-opposing front caster wheels, apparatus comprising a rotary joint adapted to be operatively interposed between said adaptive implement and said front portion of the frame of the wheelchair, the rotary joint defining a primary axis of rotation about which a rotatable joint body is capable of rotating, the rotary joint having a movable bearing adapted to transmit torque about the primary axis of rotation between a fixed joint body that is immovable relative to the front portion of the frame of the wheelchair and the rotatable joint body, the movable bearing comprising a first end and a second end, the first end of the movable bearing adapted to move into and out of a position which enables load-bearing torque transmission between the fixed joint body and the rotatable joint body about the primary axis of rotation to enable alternation between said original load-bearing configuration and said modified load-bearing configuration, the second end of the movable bearing being pivotably connected to one of the fixed joint body or the rotatable joint body, wherein, while the wheelchair is in the original load-bearing configuration, a forward portion of a load carried by the wheelchair is supported by the pair of symmetrically-opposing front caster wheels, and wherein while the wheelchair is in the modified load-bearing configuration, the forward portion of the load carried by the wheelchair is substantially supported by the adaptive implement.

11. The alternatable reconfiguration apparatus of claim 10, said adaptive implement comprising a caster assembly, said caster assembly comprising a wheel having a substantially greater diameter than that of either of the symmetrically-opposing front caster wheels of the wheelchair, said caster assembly comprising a pivotable portion having a vertical pivot axis wherein, while the wheelchair is in the modified load-bearing configuration, the wheel of the caster assembly rotates in concert with movements of the wheelchair, and the pivotable portion of the caster assembly pivots about the vertical pivot axis in response to changes in a direction of the wheelchair enacted by the user.

12. The alternatable reconfiguration apparatus of claim 10 further configured for releasable connection to the frame of the wheelchair.

13. The alternatable reconfiguration apparatus of claim 10 further configured for stowing below a seat of the wheelchair.

14. The alternatable reconfiguration apparatus of claim 10 being capable of simultaneous deployment and disengagement in conjunction with a second alternatable reconfiguration apparatus.

15. A reconfiguration system for a wheelchair for alternating the wheelchair between an original load-bearing configuration and a modified load-bearing configuration, the wheelchair comprising a frame having a front region, the wheelchair further comprising a pair of symmetrically-opposing rear wheels interconnected by a rear axle, the wheelchair further comprising a pair of symmetrically-opposing front caster wheels for supporting a forward portion of a load supported by the frame while the wheelchair is in the original load-bearing configuration, the reconfiguration system comprising:

an adaptive implement for contacting a ground surface and for supporting the forward portion of the load supported by the frame while the wheelchair is in the modified load-bearing configuration; and a load transitioning mechanism adapted to be operatively interposed between the adaptive implement and the frame of the wheelchair to define a substantially horizontal axis of rotation in proximity to the front region of the frame of the wheelchair, the load transitioning mechanism further adapted to enable a user to switchably prepare the wheelchair for alternating between the original load-bearing configuration and the modified load-bearing configuration, the load transitioning mechanism further adapted to switchably bias a movable bearing towards and away from a position of load-bearing torque transmission between a fixed joint body and a rotatable joint body about the substantially horizontal axis of rotation, the movable bearing capable of pivoting about a bearing rotation axis defined by pivotable connection of a first end of the movable bearing to one of the fixed joint body or the rotatable joint body, wherein the reconfiguration system enables both load-bearing deployment of the adaptive implement and disengagement of the adaptive implement from load-bearing as a result of toggling of the load transitioning mechanism and rearward shifting of a load carried by the wheelchair.

16. The reconfiguration system of claim 15, said adaptive implement comprising a caster assembly comprising a wheel having a diameter that is substantially greater than the diameter of either of the symmetrically-opposing front caster wheels of the wheelchair, said caster assembly further comprising a pivotable portion having a vertical pivot axis wherein, while the wheelchair is in the modified load-bearing configuration, the wheel of the caster assembly rotates in concert with movements of the frame, and the pivotable portion of the caster assembly pivots about the vertical pivot axis in response to changes in a direction of the frame enacted by the user.

17. The reconfiguration system of claim 15 further configured for stowing of the adaptive implement below a seat of the wheelchair.

18. The reconfiguration system of claim 15 being capable of simultaneous deployment and disengagement of a pair of adaptive implements connected to symmetrically-opposing portions of the front region of the frame of the wheelchair.

* * * * *